US006518568B1

(12) United States Patent
Kovtoun et al.

(10) Patent No.: US 6,518,568 B1
(45) Date of Patent: Feb. 11, 2003

(54) METHOD AND APPARATUS OF MASS-CORRELATED PULSED EXTRACTION FOR A TIME-OF-FLIGHT MASS SPECTROMETER

(75) Inventors: Viatcheslav V. Kovtoun, Reisterstown, MD (US); Robert J. Cotter, Baltimore, MD (US)

(73) Assignee: Johns Hopkins University, Baltimore, MD (US)

( * ) Notice: Subject to any disclaimer, the term of this patent is extended or adjusted under 35 U.S.C. 154(b) by 348 days.

(21) Appl. No.: 09/589,480

(22) Filed: Jun. 7, 2000

Related U.S. Application Data

(60) Provisional application No. 60/138,711, filed on Jun. 11, 1999.

(51) Int. Cl.[7] ..... H01J 48/40
(52) U.S. Cl. ..... 250/287
(58) Field of Search ..... 250/287

(56) References Cited

U.S. PATENT DOCUMENTS 2,612,607 A 9/1952 Stephens
2,685,035 A 7/1954 Wiley
4,458,149 A 7/1984 Muga
5,625,184 A 4/1997 Vestal et al.
5,627,369 A 5/1997 Vestal et al.
5,654,545 A 8/1997 Holle et al.
5,739,529 A 4/1998 Laukien et al.
5,777,325 A 7/1998 Weinberger et al.
5,869,830 A 2/1999 Franzen et al.
5,886,345 A 3/1999 Koster et al.
5,905,259 A 5/1999 Franzen
5,969,348 A 10/1999 Franzen
6,348,688 B1 * 2/2002 Vestal ..... 250/287
6,441,369 B1 * 8/2002 Vestal et al. ..... 250/28
6,469,296 B1 * 10/2002 Hansel et al. ..... 250/287 7
6,469,296 B1 * 10/2002 Hansel et al. ..... 250/287
6,469,296 B1 * 10/2002 Hansel et al. ..... 250/287

OTHER PUBLICATIONS

Stephens, W.E., Phys. Rev., vol. 69, p. 691, 1946.
Keller, R., Helv. Phys. Acta., vol. 22, p. 386–89, 1949.
Wiley, W.C., et al., Rev. Sci. Instrumen., vol. 26, pp. 1150–1157, 1955.
Wiley, W.C., et al., Science, vol. 124, pp. 817–820, 1956.
Mamyrin, B.A., et al., Sov. Phys. JETP, vol. 37, p. 45–48, 1973.
Van Breeman, R.B., et al., Int. J. Mass Spectrom. Ion Phys., vol. 49, pp. 35–50, 1983.
Cotter, R.J., Biomed. Environ. Mass Spectrom., vol. 18, pp. 513–532, 1989.
Olthoff, J.K., et al., Anal. Chem., vol. 59, pp. 999–1002, 1987.
Whittal, R.M., et al, Anal. Chem., vol. 67, pp. 1950–1954, 1995.
Brown, R.S., et al., Anal. Chem., vol. 67, pp. 1998–2003, 1995.

(List continued on next page.)

*Primary Examiner*—John R. Lee
*Assistant Examiner*—Johnnie L Smith, II
(74) *Attorney, Agent, or Firm*—Kirk D. Houser; Eckert Seamans Cherin & Mellott, LLC

(57) ABSTRACT

A time-of-flight mass spectrometer includes a sample holder for a sample and an ionizer for ionizing the sample to form ions. A first element is spaced downstream from the sample holder, a second element is spaced downstream from the first element, and a drift region is downstream of the second element. An electric field is established between the sample holder and the first element at a time subsequent to ionizing the sample in order to extract the ions. A time-dependent and mass-correlated electric field is established between at least one of: (a) the first element and the second element, and (b) the sample holder and the first element. In turn, a detector detects the ions.

36 Claims, 15 Drawing Sheets

OTHER PUBLICATIONS

Vestal, M.L., et al., Rapid Commun. Mass Spectrom., vol. 9, pp. 1044–1050, 1995.
Edmondson, R.D., et al, J. Am. Soc. Mass Spectrom., vol. 7, pp. 995–1001, 1996.
Colby, S.M., et al., Rapid Commun. Mass Spectrom., vol. 8, p. 865–68, 1994.
Kovtoun, S.V., Rapid Commun. Mass Spectrom., vol. 11, pp. 433–436, 1997.
Marable, N.L., et al., Int. J. Mass Spectrom. Ion Phys., vol. 13, pp. 185–194, 1974.
Kinsel, G.R., et al., Int. J. Mass Spectrom. Ion Phys., vol. 91, pp. 157–176, 1989.
Kinsel, G.R., et al., Int. J. Mass Spectrom. Ion Phys., vol. 104, pp. 35–44, 1991.
Kinsel, G.R., et al., J. Am. Soc. Mass Spectrom., vol. 4, pp. 2–10, 1993.
Grundwuermer, J.M., et al., Int. J. Mass Spectrom. Ion Phys., vol. 131, pp. 139–148, 1994.
Yefchak, G.E., et al., Int. J. Mass Spectrom. Ion Phys., vol. 87, pp. 313–330, 1989.
Whittal, R.M., et al., Anal. Chem., vol. 69, pp. 2147–2153, 1997.
Franzen, J., Int. J. Mass Spectrom. Ion Phys., vol. 164, pp. 19–34, 1997.
Amft, M., et al., Rapid Commun. Mass Spectrom., vol. 12, pp. 1879–1888, 1998.
Spengler, B., Anal. Chem., vol. 67, pp. 793–796, 1990.

* cited by examiner

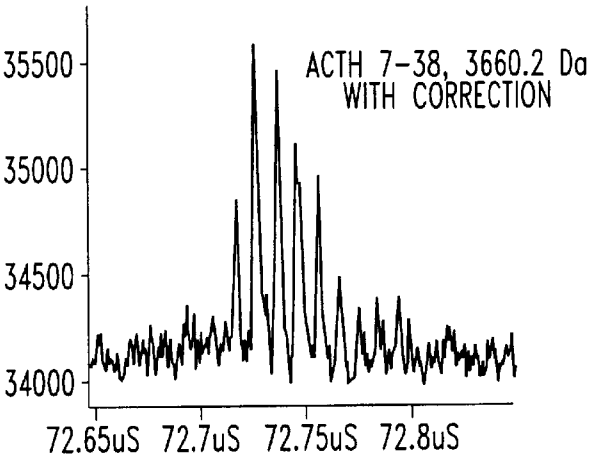
FIG. 16E
FIG. 16F
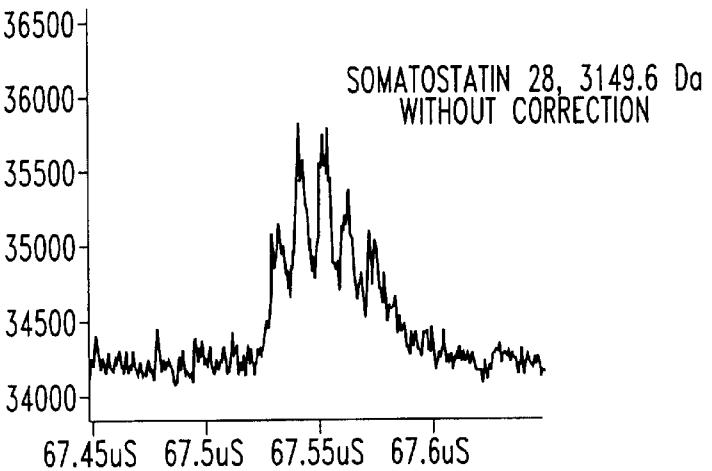
FIG. 16G
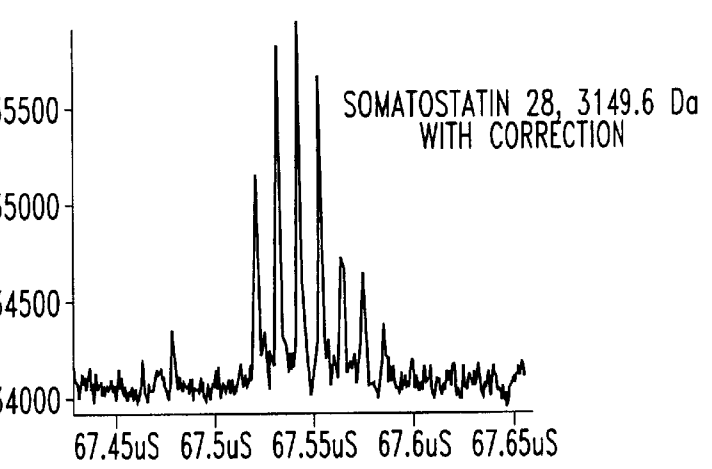
FIG. 16H

METHOD AND APPARATUS OF MASS-CORRELATED PULSED EXTRACTION FOR A TIME-OF-FLIGHT MASS SPECTROMETER

CROSS REFERENCE TO RELATED APPLICATION

This application claims the benefit of U.S. Provisional Application Ser. No. 60/138,711, filed Jun. 11, 1999.

BACKGROUND OF THE INVENTION

1. Field of the Invention

This invention relates to time-of-flight (TOF) mass spectrometers and, in particular, to a mechanism for improving the quality of mass spectra obtained from a TOF mass spectrometer. The invention also relates to a method for improving mass resolution in such TOF instruments in which the initial velocity distribution of ions dominates other mechanisms, such as spatial and temporal distributions, that normally result in loss of mass resolution.

2. Background Information

The use of mass spectrometers in determining the identity and quantity of constituent materials in a gaseous, liquid or solid specimen or sample has long been known. Mass spectrometers or mass filters typically use the ratio of the mass of an ion to its charge, m/z, for analyzing and separating ions. The ion mass m is typically expressed in atomic mass units or Daltons (Da) and the ion charge z is the charge on the ion in terms of the number of electron charges e.

In recent years, the development of an ionization technique for mass spectrometers known as matrix-assisted laser desorption ionization (MALDI) has generated considerable interest in the use of TOF mass spectrometers and in improvements of their performance. MALDI is particularly effective in ionizing large biological molecules (e.g., peptides and proteins, carbohydrates and oligonucleotides), as well as other types of polymers.

The TOF mass spectrometer provides an advantage for MALDI analysis by simultaneously recording ions over a broad mass range, which is the so-called multichannel advantage. At the same time, it has become common to utilize a method for improving mass resolution in a TOF mass spectrometer (i.e., time-lag focusing) which compromises the multi-channel advantage because it is mass-dependent. That is, the magnitude of the time delay between ionization and ion extraction used to provide first-order velocity focusing depends upon mass, so that only a portion of the mass spectrum is in first-order focus.

Mass spectrometers are analytical instruments which determine chemical structures through measurement of the masses of intact molecules and structure-specific fragments. Mass spectrometers consist of a mechanism for ionizing molecules (i.e., an ionization source) so that they can be analyzed by movement, manipulation or selection in some combination of static or dynamic electric and/or magnetic fields (mass analyzer) before arriving at a detector. Common ionization sources include electron ionization (EI), chemical ionization (CI),fast atom bombardment (FAB), electrospray ionization (ESI) and matrix-assisted laser desorption ionization (MALDI). Mass analyzers include magnetic sector (B), quadrupole (Q), quadrupole ion trap (QIT), Fourier transform mass spectrometers (FTMS) and time-of-flight (TOF).

The simplest time-of-flight mass spectrometer consists of a short ion source region of length s (shown in FIG. 1) and a longer drift region D. Ions formed in the source are accelerated by the high electrical field E defined by the potential difference V between the front (i.e., grid) and rear (i.e., backing plate) of the ion source. Then, the ions enter the length of the drift region D (or flight tube) with kinetic energies $eV=\frac{1}{2}mv^2$ and velocities $v=(2\,eV/m)^{1/2}$ which are different for each mass m. The resultant mass spectrum (shown in FIG. 2) is obtained by recording the flight times of ions reaching the detector, with time, t, being approximated by:

$$t=\left(\frac{m}{2eV}\right)^{1/2}D$$

The earliest known time-of-flight mass spectrometers, see Stephens, W. E., *Phys. Rev.*, vol. 69, p. 691, 1946; U.S. Pat. No. 2,612,607; Keller, R., *Helv. Phys. Acta.*, vol. 22, p. 386, 1949, had very poor mass resolution (i.e., the ability to distinguish ions having nearly the same mass at different flight times). This arises because the actual flight time, t, of an ion reflects uncertainties in the time of ion formation, $t_0$, and the initial position, s, and kinetic energy, $U_0$, of an ion prior to acceleration:

$$t=\frac{(2m)^{1/2}}{eE}[(U_0+eEs)^{1/2}\mp U_0^{1/2}]+\frac{(2m)^{1/2}D}{2(U_0+eEs)^{1/2}}+t_0$$

Later, an instrument that addressed the effects of initial temporal, spatial and kinetic energy (or velocity) distributions achieved considerably improved mass resolution. See Wiley, W. C., et al., *Rev. Sci. Instrumen.*, vol. 26, pp. 1150–57, 1955. In this instrument, an ion extraction pulse with a fast rise-time minimized the temporal distribution, while a dual-stage source (see FIG. 3) provided first-order space focusing when the detector was located at a distance:

$$d=2\sigma^{3/2}\left[\frac{1}{s_0^{1/2}}-\frac{2s_1}{s_0^{1/2}(\sigma^{1/2}+s_0^{1/2})^2}\right]$$

wherein:

$\sigma=s_0+(E_1/E_0)s_1$, and $E_0$ and $E_1$ are the electric fields in the two regions $s_0$ and $s_1$ of the dual-stage source, respectively.

The so-called space-focus plane (d) is independent of mass. That is ions of all masses achieve first-order focusing at this location for given values of $E_0$, $E_1$, $s_0$ and $s_1$. In addition, it is also possible, using specific values of $E_0$, $E_1$, $s_0$ and $s_1$ to achieve second-order, mass-independent focusing. First-order kinetic energy (velocity) focusing is achieved using a time delay between the ionization pulse and the extraction pulse, a scheme known as time-lag focusing. See U.S. Pat. No. 2,685,035.

Time-lag focusing is mass-dependent, with the optimal time delay for velocity focusing being different for each mass. Hence, methods used to obtain mass spectra utilize a boxcar approach in which the time-lag is scanned in each successive time-of-flight recording cycle. A time-of-flight (TOF) instrument based upon the design of this instrument is disclosed by Wiley, W. C., et al., *Science*, vol. 124, pp. 817–20, 1956.

More recently, the development of methods that form ions directly from surfaces using fast pulse lasers and ion beams has generally reduced both the temporal and spatial distributions associated with ion formation, obviating the need for pulsed ion extraction. In these static TOF instruments, ion reflectrons, see Mamyrin, B. A., et al., *Sov. Phys. JETP*, vol.

37, p. 45, 1973, provide a simple and mass-independent method for energy focusing.

However, pulsed ion extraction has been employed in instruments utilizing infrared laser desorption, see Van Breeman, R. B., et al., *Int. J. Mass Spectrom. Ion Phys.*, vol. 49, pp. 35–50, 1983, and Cotter, R. J., *Biomed. Environ. Mass Spectrom.*, vol. 18, pp. 513–32, 1989; pulsed ion beams, see Olthoff, J. K., et al., *Anal. Chem.*, vol. 59, pp. 999–1002, 1987; and matrix-assisted laser desorption, see Spengler, B., *Anal. Chem.*, vol. 67, pp. 793–96, 1990, as methods of ionization.

It is known to employ a time-delayed focusing scheme, which is operationally similar to that of the instrument of U.S. Pat. No. 2,685,035, to compensate for relatively broad ionization pulses and/or to enable observation of ions fragmenting over a long time period. See Cotter, R. J., *Biomed. Environ. Mass Spectrom.*

Subsequently, others have reported extraordinary improvements in MALDI mass spectra using pulsed ion extraction. See Whittal, R. M., et al, *Anal. Chem.*, vol. 67, pp. 1950–54, 1995; Brown, R. S., et al., *Anal. Chem.*, vol. 67, pp. 1998–2003, 1995; and Vestal, M. L., et al., *Rapid Commun. Mass Spectrom.*, vol. 9, pp. 1022–50, 1995. Time-lag focusing, time-delayed extraction, and delayed extraction have been used to describe this method which is employed on modern MALDI time-of-flight mass spectrometers. Similar to the instrument of U.S. Pat. No. 2,685,035, such newer instruments utilize dual-stage extraction sources in which the first extraction field is pulsed, although there are some differences in which the source element is pulsed.

As shown in FIG. 4, the instrument of U.S. Pat. No. 2,685,035 uses a grounded ion source plate (Ue=0V), and a negative-going voltage pulse (Ua=−64V after a suitable delay) at the intermediate grid.

Referring to FIG. 5, the instruments disclosed in U.S. Pat. Nos. 5,625,184 and 5,627,369, and Edmondson, R. D., et al, *J. Am. Soc. Mass Spectrom.*, vol. 7, pp. 995–1001, 1996, employ a high voltage source with a positive-going pulse on the ion source plate (Ue=18 kV to 20 kV) after a suitable delay, and a constant voltage (Ua=18 kV) at the intermediate grid.

As shown in FIG. 6, other instruments disclosed in U.S. Pat. No. 5,739,529 employ a high voltage source (Ue=20 kV) with a negative-going pulse on the intermediate grid (Ue=20 kV to less than 20 kV) after a suitable delay.

While the absence of a spatial distribution accounts for much of the improvement in mass resolution in MALDI instruments, see Colby, S. M., et al., *Rapid Commun. Mass Spectrom.*, vol. 8, p. 865, 1994, energy (velocity) focusing using time-delayed extraction remains mass-dependent and, hence, there is room for improvement.

A mass-correlated approach employing a single ion extraction stage is disclosed by Kovtoun, S. V., *Rapid Commun. Mass Spectrom.*, vol. 11, pp. 433–36, 1997.

Other dynamic methods of velocity (energy) focusing exist and can be divided into techniques that utilize square wave pulses (i.e., an electric field is switched between two discrete values) and methods providing continuously varying fields as each iso-mass ion packet passes through the field. Methods which employ square waveforms of pulses include: (1) conventional time-lag or delayed extraction methods described above; (2) impulse-field focusing, see Marable, N. L., et al., *Int. J Mass Spectrom. Ion Phys.*, vol. 13, pp. 185–94, 1974; and (3) post-source acceleration, see Kinsel, G. R., et al., *Int. J. Mass Spectrom. Ion Phys.*, vol. 91, pp. 157–76, 1989; Kinsel, G. R., et al., *Int. J. Mass Spectrom. Ion Phys.*, vol. 104, pp. 35–44, 1991; Kinsel, G. R., et al., *J. Am. Soc. Mass Spectrom.*, vol. 4, pp. 2–10, 1993; Grundwuermer, J. M., et al., *Int. J. Mass Spectrom. Ion Phys.*, vol. 131, pp. 139–48, 1994; and Amft, M., et al., *Rapid Commun. Mass Spectrom.*, vol. 12, pp. 1879–88, 1998.

In time-lag focusing, the electric field in the extraction region of the ion source, being initially at zero, is turned on after a specified delay, following the ionization pulse. The principle of this compensation mechanism is based on the assumption that the leading ions have a larger initial velocity, enter deeper into the extraction region compared to slower iso-mass ions and, thus, acquire less potential energy as the extraction pulse is applied. The time delay that enables ions of lower initial velocity to catch up to the leading ions as they reach the detector plane is mass dependent. This is a major drawback of a method which sacrifices mass resolution for all but a narrow portion of the mass spectrum.

Impulse-field focusing is technically similar to conventional time-lag focusing and also employs a two-field ion source. However, the electric field is turned on not from zero to a final value, but rather from an initial (high) $E_\tau$ to a final (low) $E_s$ value. The idea is that the first-stage increases in draw-out field reduces the ion turnaround time. Then, after delay $\tau$, the field $E_s$ takes the value typical of conventional focusing as disclosed by U.S. Pat. No. 2,685,035. For example, a significant extension of the mass range resolved is achieved for a 98 cm drift region with the calculated maximum focused mass m/z being increased from 220 to 2250 Da. Similarly, with a 167 cm drift region, the mass m/z is increased from 360 to 4300 Da, and increasing with $\tau$. Nevertheless, the method is still mass-dependent because of the mass dependence of $E_{96}$ .

Post-source pulse focusing (PSPF) or post-source acceleration is also able to partially compensate for the initial velocity and time distributions in the iso-mass packet. The principle of compensation is based on the following model. Ions, having initial velocities equal in magnitude but of opposite direction (+v and −v), enter the drift tube with the same velocity +v, being separated in space by a distance related to the turnaround time. The same spatial separation occurs for ions formed at different times in the ion source. Unlike the static field TOF mass spectrometer, the ions enter a short, initially field-free pulse-focusing region prior to the drift region. After all iso-mass ion packets of interest reach this region, a voltage pulse is applied. Thereafter, a mechanism similar to that of U.S. Pat. No. 2,685,035 is invoked in order that trailing ions acquire higher energy as the pulse-voltage field is on, compared to the leading ions. Hence, the compression of individual ion packets is achieved as they reach the detector.

As described in Kinsel, G. R., et al., *J. Am. Soc. Mass Spectrom.*, this approach provides focusing for a large portion, but not all, of the mass spectrum. However, this portion may be about 80% or larger. Increases in this mass range require lengthening the pulse-voltage region and also the focusing pulse voltage. For example, improvements in mass resolution of the MALDI spectrum of angiotensin II (MW 1046 Da) from 50 to 2750 may be observed by employing the PSPF technique with a 2 m linear TOF mass spectrometer which incorporates a 10 cm PSPF region adjacent to the ion source. See also Amft, M., et al., *Rapid Commun. Mass Spectrom.*, wherein the observed mass resolution for MALDI generated ions is about 7000. Each individual setting of PSPF parameters (the delay time and the amplitude of the square wave pulse) allowed the recording of a mass range about 2000 Da with high mass resolution.

Methods using monotonically time-varying fields may also be separated into those not employing time-lag and those that do. Methods of velocity compaction as disclosed by U.S. Pat. No. 4,458,149, and dynamic-field focusing (DFF) by Yefchak, G. E., et al., *Int. J. Mass Spectrom. Ion Phys.*, vol. 87, pp. 313–30, 1989, fall into the first category.

Velocity compaction uses a monotonically changing correction field adjusted in such a manner that ions having lower velocity receive a greater acceleration than ions moving at a faster velocity. Thus, iso-mass ions are compacted velocity-wise. Simultaneously, space-wise compaction is achieved if the trailing edge of the ion packet corresponds to lower initial velocity, which is generally true when the initial velocity distribution dominates other distributions. This model considers ions entering the varying acceleration region at the same time, but with different velocities. Upon entering the varying acceleration region, those ions are subjected to a time-varying increasing field such that all ions of a given mass simultaneously entering that region reach the same velocity upon leaving this region.

Velocity compaction is not the same as a velocity focusing because the latter does not require equal velocities, but rather fast ions in the iso-mass packet catch up with slower ions exactly at the detector plane. Velocity compaction does not account for the temporal spread of the ion packet before entering the varying acceleration region. Also, simultaneous velocity and space compaction has to be provided since the spatial spread of the ion packet occurs as ions are velocity compacted. There is a slight mass dependence of the focal position as both types of compaction are effected.

The velocity adjustment focusing principle, which characterizes dynamic-field focusing (DFF), is also dependent on designing an acceleration function which brings about focusing for ions of each mass individually. For this purpose, the conventional drift region is separated into two regions between which the DFF region is situated. As in the previous case, ions arriving later receive larger acceleration then leading ions. The applied acceleration is contoured in such a manner as to cause the trailing ions to catch up with the leading ions at the detector plane. This method needs an additional section to be inserted into the drift region where the first drift region serves to provide initial separation of iso-mass ions related to their velocities.

Among those methods utilizing time-varied fields in conjunction with time-lag focusing, and most suitable to MALDI conditions, are the method of functional wave time-lag focusing, see Whittal, R. M., et al., *Anal. Chem.*, vol. 69, pp. 2147–53, 1997, and U.S. Pat. No. 5,777,325; and spot focusing or wide-range focusing, see Franzen, J., *Int. J. Mass Spectrom. Ion Phys.*, vol. 164, pp. 19–34, 1997; and U.S. Pat. No. 5,969,348. Both of these methods employ in-source time-varying electric fields.

Functional wave time-lag focusing addresses the issue of improving mass accuracy, and a voltage pulse shape is derived so as to maintain constant total kinetic energy for all ions exiting the ion source. Experiments demonstrate improvements not only in mass accuracy but also in mass resolution. As described above, achievement of equal ion velocities, or (equivalently) equal kinetic energies, may correlate with, but does not necessarily imply, velocity (energy) focusing.

SUMMARY OF THE INVENTION

A particular extraction pulse amplitude and/or delay time results in focusing only a narrow range of mass. Therefore, to fully realize the multi-channel recording advantage of the TOF mass spectrometer, it is necessary to bring all of the ions into focus simultaneously. The wide-range focusing method disclosed herein addresses the issue of mass resolution improvement. Wide-range focusing by an in-source, time-varying extraction pulse which is properly contoured takes into account a suitable space-velocity correlation for MALDI ions. The present invention provides a pulsed extraction method for improving mass resolution that is not mass dependent, thereby resulting in identical first-order focusing conditions along an entire recorded mass range. In order to fully apply the multi-channel recording advantage of a TOF mass spectrometer, all of the ions may be brought into focus simultaneously by employing a time-dependent function which is correlated with mass.

In accordance with the invention, a time-of-flight mass spectrometer comprises: a sample holder for a sample; an ionizer for ionizing the sample to form ions; a first element spaced downstream from the sample holder; a second element spaced downstream from the first element; a drift region downstream of the second element; means for establishing an electric field between the sample holder and the first element at a time subsequent to ionizing the sample in order to extract the ions; means for establishing a time-dependent and mass-correlated electric field between at least one of: (a) the first element and the second element, and (b) the sample holder and the first element; and means for detecting the ions.

As another aspect of the invention, a time-of-flight mass spectrometer comprises: a sample holder for a sample; an ionizer for ionizing the sample to form ions; a first element spaced downstream from the sample holder; a second element spaced downstream from the first element; a drift region downstream of the second element; a power source electrically coupled to the first element for applying a constant first voltage thereto; means electrically coupled to the sample holder for applying the first voltage thereto for a time subsequent to ionizing the sample, and for applying a second voltage, which is different than the first voltage, after the time in order to extract the ions; means electrically coupled to the second element for applying a time-dependent and mass-correlated voltage thereto; and means for detecting the ions.

As a further aspect of the invention, a time-of-flight mass spectrometer comprises: a sample holder for a sample; an ionizer for ionizing the sample to form ions; an extraction plate electrically coupled to the sample holder; a first element spaced downstream from the extraction plate; a second element spaced downstream from the first element, with the extraction plate and the first element defining an extraction section therebetween, and with the first element and the second element defining an acceleration section therebetween; a drift region downstream of the second element; a power source electrically coupled to the first element for applying a constant first voltage thereto; means electrically coupled to the extraction plate for applying the first voltage thereto for a time subsequent to ionizing the sample, and for applying a second voltage, which is different than the first voltage, after the time in order to extract the ions; means electrically coupled to the second element for applying a time-dependent and mass-correlated voltage thereto; and means for detecting the ions.

As another aspect of the invention, a method of mass-correlating the extraction of ions for a time-of-flight mass spectrometer comprises: ionizing a sample to form ions; employing an extraction plate adjacent the sample; employing a first element spaced downstream from the extraction plate; employing a second element spaced downstream from the first element; employing a drift region downstream of the second element; establishing an electric field between the extraction plate and the first element at a time subsequent to ionizing the sample; extracting the ions; establishing a time-dependent and mass-correlated electric field between at least one of: (a) the first element and the second element, and (b) the extraction plate and the first element; and detecting the ions.

BRIEF DESCRIPTION OF THE DRAWINGS

A full understanding of the invention can be understood when read in connection with the accompanying drawings in which.

DESCRIPTION OF THE PREFERRED EMBODIMENTS

As employed herein, the term "ions" shall expressly include, but not be limited to, electrically charged particles formed from either atoms or molecules by extraction or attachment of electrons, protons or other charged species.

Several variations of voltage waveforms (e.g., linear, parabolic, exponential) may be simulated in a mathematical analysis of wide-range focusing. A suitable functional waveform of the acceleration field (i.e., not just any positive-going pulse) enables achievement of those focusing properties which provide the wide-range velocity focusing method disclosed herein.

Figure 7:
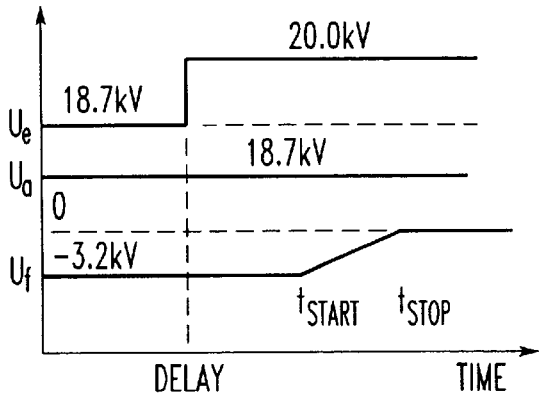
FIG. 7 is a plot of voltages employed by a time-of-flight mass spectrometer in accordance with the present invention.

Referring to FIG. 7, the present invention applies a time-dependent (and mass-correlated) function to the second extraction region of a dual-stage ion extraction source in which the first region is pulsed. This method may be employed with a wide variety of TOF mass spectrometers, including ion sources having initial temporal and spatial distributions of ions that are negligible compared to their initial velocity (energy) distributions. This includes a wide range of pulsed methods for ion production on the surface of the sample (e.g., ion bombardment, laser desorption, MALDI, which are extensively used for the analysis of biomolecules).

As shown in FIG. 7, an exemplary positive-going pulse is employed on the source (Ue=18.7 kV to 20.0 kV) after a suitable delay following ionizing the sample in order to extract the ions. A constant voltage (Ua=18.7 kV) is employed on the intermediate grid. A time-dependent (and mass-correlated) function is applied to the second extraction region (Uf=−3.2 kV to about 0 V).

Figure 1:
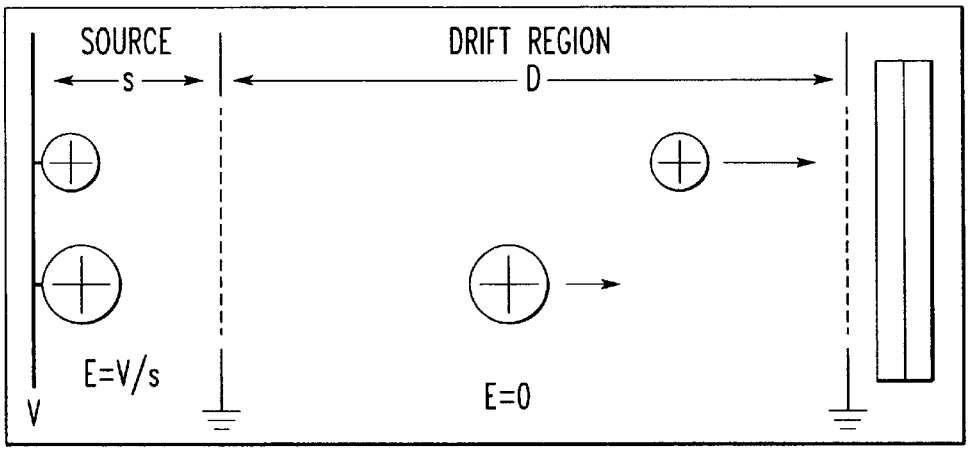
FIG. 1 PRIOR ART
FIG. 1 is simplified block diagram of a time-of-flight mass spectrometer having a short ion source region and a longer drift region.
Figure 2:
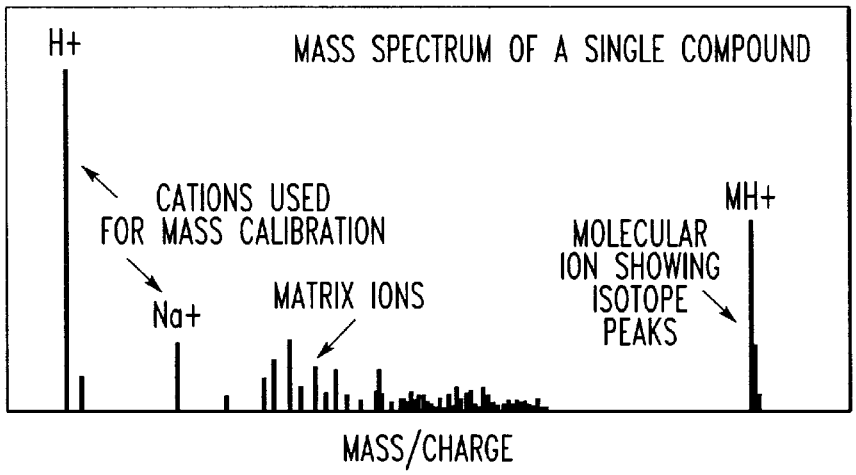
FIG. 2 PRIOR ART
FIG. 2 is a plot of a mass spectrum of a time-of-flight mass spectrometer.
Figure 3:
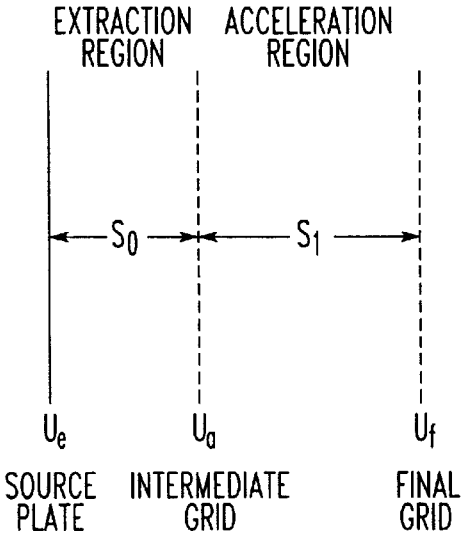
FIG. 3 PRIOR ART
FIG. 3 is a block diagram of a linear, double-stage, ion source for a time-of-flight mass spectrometer.
Figure 4:
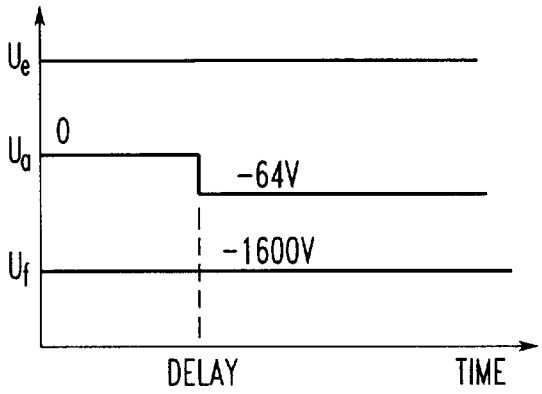
FIG.4 PRIOR ART
FIG. 4 is a plot of voltages employed by a time-of-flight mass spectrometer.
Figure 5:
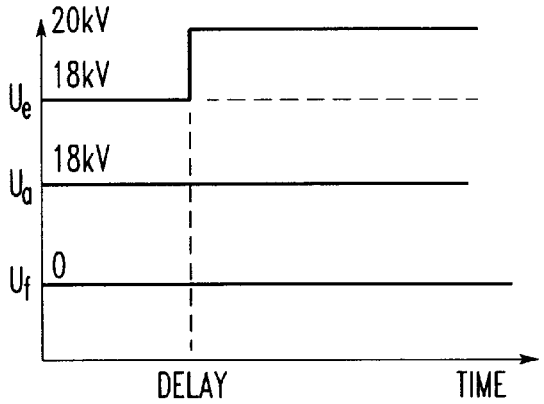
FIG.5 PRIOR ART
FIG. 5 is a plot of voltages employed by a time-of-flight mass spectrometer.
Figure 6:
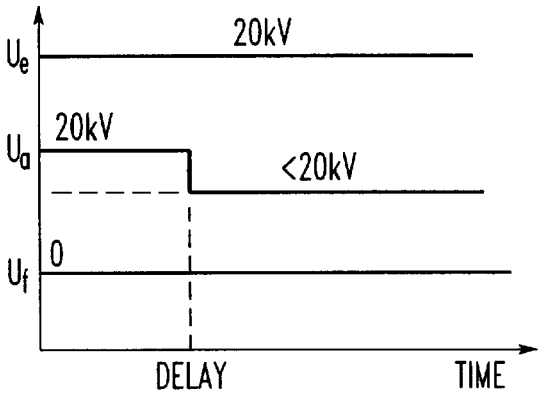
FIG.6 PRIOR ART
FIG. 6 is a plot of voltages employed by a time-of-flight mass spectrometer.

Referring again to FIG. 3, a conventional linear, double-stage, ion source for a TOF mass spectrometer is shown. For a given mass M, the optimal delay T is obtained by solving a nonlinear equation, Equation 1, with respect to the unknown (substitute) parameter x:

$$\beta\cdot\left[-\beta+\frac{2}{D_0\cdot a_z\cdot\left(\frac{1}{\sqrt{1+x}}-\frac{1}{\sqrt{z+x}}\right)-L_0\cdot\frac{z}{(1+x)^{3/2}}+\frac{1}{\sqrt{z+x}}}\right]-x=0 \tag{1}$$

$$T=\frac{2\cdot d_e}{V_{M_0}}\cdot\left(\frac{\beta}{2z}-\frac{x}{2\beta z}\right)$$

Wherein:

$$D_0=\frac{d_a}{d_e}$$

$$L_0=\frac{L}{2d_e}$$

$$z=\frac{U_e}{U_a+U_e}\ -$$

ratio of extraction to total acceleration voltages ($U_a$+$U_e$)

$$a_z=\frac{z}{1-z}$$

$$V_{M_0}=\sqrt{\frac{2e(U_e+U_a)}{M_0}}\ -$$

final velocity, ions of mass $M_0$ reaching the exit of ion source, starting with zero initial velocity $$\beta=\frac{V_0}{V_{M_0}}\ -$$

ratio of averaged initial to a final velocity of ions of mass $M_0$ $d_e$ is geometric length of the extraction region;

$d_a$ is geometric length of the acceleration region;

L is geometric length of the drift tube;

T is temporal delay time between ion production and extraction;

$U_e$ is electrical extraction voltage; and $U_a$ is electrical acceleration voltage.

The foregoing parameters are suitable for ions varying in masses from hundreds of Daltons (Da) to several MDa.

With only a minor loss in accuracy, not exceeding about 2% for an embodiment considered, the time delay, T, of Equation 1 may be obtained from $$T = \frac{2d_e}{V_{M_0}} \cdot \left( \frac{\beta}{z} + \frac{1}{\sqrt{z} \cdot \left( L_0 \cdot z^{3/2} + \frac{D_0 \cdot z}{1+\sqrt{z}} - 1 \right)} \right) \tag{2}$$

The time delay, T, of Equation 2 is mass-dependent which dependence comes from the final velocity term, $V_{M0}$, and reduced velocity parameter, β, (i.e., one needs to adjust the delay while switching to another mass of the ions of interest). Also, in MALDI, the contribution to the delay time caused by the non-zero average velocity of desorbing ions (parameter β) appears to be more significant when referring to larger ion masses, since the value of the average initial velocity, $V_0$, is approximately mass-independent, while the final velocity, $V_{M0}$, is inversely proportional to the square of the mass. Low mass ions need shorter delay times, while high mass ions need longer delays. Also, for a given mass, $M_0$, and its optimum delay time, $T_{M0}$, (as follows from Equation 2), ions of mass M larger than reference mass $M_0$ are focused behind the detector plane, while relatively low mass ($m < M_0$) ions are focused in front of it. This means that there is a mass-dependent spread of focal points across the detector plane, while the exact focus to the detector location is implemented only for reference mass $M_0$ ions.

Therefore, in the standard time-lag focusing technique applied to MALDI, assuming that the actual value of the initial velocity $V_0$ is not known, the delay time is calculated based on a rough estimation of $V_0$, and, then, a final adjustment of the delay time (or extraction voltage) is made experimentally, based on the best mass resolution achieved.

The idea of a method of velocity focusing over the entire mass range as disclosed herein is to provide a mechanism for compensating the velocity distribution for those ions in the recorded mass range which have a non-optimal delay time. This compensation is accomplished in consecutive steps, for all ions in the spectrum of interest, by introducing an additional, time-varying potential to the existing static field. This provides a fine energy adjustment to each individual mass packet, and among packets, by supplying to those initially slow ions sufficient additional energy to catch up with initially faster ions at the same spatial location (i.e., the detector plane). This corresponds to satisfying the first order velocity focusing condition along the entire mass range of interest.

If the mass range to be recorded spans from a low value, $m_0$, to a high value, $M_0$, then the procedure for compensation may be implemented in a variety of ways which are sub-divided into two basic categories. First, correction of ion velocity (or kinetic energy) is carried out continuously from low to high mass ion packets, tracing each iso-mass packet as ions leave the region with a correction potential (i.e., low mass ions leave first). Here, the static-field optimization of geometry and static voltages provides first-order focusing at the detector plane only for the lowest mass $m_0$ ions, noted as the reference mass. Ions of this and lower mass are not subjected to correction. In the geometry observed, this may be achieved by applying a correction potential directly to the extraction electrode, from the moment ions of lowest mass $m_0$ in the spectrum leave the extraction region.

Alternatively, correction is applied while different mass ions are entering the region of correction potential (i.e., low mass ions enter first). This region may have both static and time-varied electric fields. In this case, opposite to the first option, the static field set-up provides first-order focusing only for the high mass end $M_0$, (the reference mass in this case) ions, while other ions are subjected to a correction potential. The more the ion mass differs from the reference mass, the larger correction is required. The correction potential vanishes at the moment ions of mass $M_0$, (or of greater mass) enter the correction region. This option has better flexibility and may also be implemented in different ways. For example, a correction region may be employed in a second stage of the ion source. Also, an additional section may be introduced immediately behind the ion source or a variable potential may be applied to the drift tube, thereby making this region indeed "field-free" only for ions of mass $M_0$, or higher mass.

The second option is preferred, not only because of greater flexibility, but also because of less pronounced mass effects in the mass-dependent term of the second derivative of ion flight times with respect to the initial velocity.

An estimation of mass dependency in the dominant component in the second order correction term, $\Delta t_2$, to total time of flight reduces to the expression shown in Equation 3:

$$\Delta t_2 = -\left(\frac{L}{2V_M}\right) \cdot \beta_0^2 \cdot \Gamma(z, d_e, d_a, L_0) \cdot \left(\frac{M}{M_0}\right) \approx \left(\frac{M}{M_0}\right)^{3/2} \tag{3}$$

where $\Gamma(z, d_e, d_a, L_0)$ is both geometry and z—dependent function.

And wherein:

$V_M$ is velocity of an ion of mass M.

Hence, the effect from this term, $\Delta t_2$, may be significantly reduced when ions in a mass range of interest are lighter then the reference mass $M<M_0$ (second group) compared to the opposite case of $M>m_0$ (first group).

The following discloses a suitable algorithm for derivation of the corrected potential field applied to the second stage of a standard double-stage ion source TOF mass spectrometer. A linear TOF mass spectrometer configuration consists of a double-stage ion source, in which $d_e$ is the extraction region length, $d_a$ is the acceleration region length, and L is the length of the drift tube region as terminated with an ion detector. A time-varying electric field is applied, in addition to a static field, in the second section of the ion source, thereby providing first-order focusing conditions for a range of ion masses, spanning from low mass, $m_0$, to high mass, $M_0$. In the first (extraction) section, the electric field is initially equal to zero during the delay time, T, after the laser shot. Both voltages of the extraction and acceleration electrode are equal to the static potential $U_0$. At time T, the voltage on the extraction electrode is switched rapidly from its initial value $U_a$, to the total voltage $U_0$ of the ion source.

In summary:

$\Delta U = U_0 - U_a = zU_0$ is voltage, applied across the extraction region, after delay T, and $U_a = U_0(1-z)$, wherein z is ratio of energy which ions acquire in the extraction region to total energy.

The starting time for the flight time of all ions is defined to be the moment, following the interval T after the laser shot, as the extraction pulse is applied. The velocity of ions of mass m exiting the extraction region (at any point A on the time axis) is shown in Equation 5 as derived from Equation 4:

$$\frac{mv_A^2}{2} = \frac{mv_0^2}{2} + eU_0z\left(1 - \frac{v_0T}{d_e}\right) \tag{4}$$

$$v_A = \sqrt{\left(\frac{v_{M_0}}{X}\right)^2 \cdot \left(1 - \frac{v_0T}{d_e}\right) + v_0^2} = \left(\frac{v_{M_0}}{X}\right) \cdot \sqrt{1 - 2\beta\, w + \beta^2X^2} \tag{5}$$

Travel time $t_A$ through t his region is $$t_A = \frac{\frac{v_{M_0}}{X} \cdot \sqrt{1 - 2\beta\, w + \beta^2X^2}}{\frac{ezU_0}{md_e}} = \tau X \cdot \left(\sqrt{1 - 2\beta\, w + \beta^2X^2} - \beta X\right) \tag{6}$$

wherein $$\tau = \frac{2d_e}{v_{M_0}} \text{ -}$$

time, ions of mass $M_0$ being initially at rest, spend in the extraction region $w = T/\tau$–scaled delay time $$X = \sqrt{\frac{zm}{M_0}} \text{ -}$$

reduced mass parameter

In Equations 4–6, the ion of largest mass $M_0$ in the spectrum is taken as the reference. In the acceleration region, where both static and varying fields are applied, ion motion is described by Equation 7:

$$\frac{m\,dv}{dt} = \frac{e[U_0(1-z) + U_0 \cdot u(t)]}{d_a} \tag{7}$$

wherein $U(t) = U_0 \cdot u(t)$ is a varying correction voltage applied to acceleration region along with a static counterpart $U_0(1-z)$. Integration of the last equation (7) gives the velocity, ions of mass m have at the specific moment $\xi$, while travelling in the acceleration region.

In this region, where both static and varying electric fields are applied, the velocity at any moment $\xi$ is given by Equation 8:

$$v_\xi = \frac{eU_0(1-z)}{md_a} \cdot (\xi - t_A) + \frac{eU_0}{md_a} \cdot \int_A^\xi u(\zeta)\,d\zeta + v_A \tag{8}$$

Equation 9 is obtained upon integration of Equation 8:

$$d_a = \int_{t_A}^{t_B} v_\xi\,d\xi = \frac{eU_0(1-z)}{2md_a}(t_B - t_A)^2 + \frac{eU_0}{md_a} \cdot \int_{t_A}^{t_B} d\xi \cdot \int_{t_A}^{\xi} u(\zeta)\,d\zeta + v_A(t_B - t_A) \tag{9}$$

The integral of Equation 9 may be reduced to the form of Equation 10:

$$\frac{\tilde{d}_0}{2} = \left(\frac{1-z}{z}\right)\frac{1}{2X^2\tilde{d}_0} \cdot (\tilde{t}_B - \tilde{t}_A)^2 + \frac{1}{zX^2\tilde{d}_0}\int_{\tilde{t}_A}^{\tilde{t}_B} d\xi \cdot \int_{t_A}^{\xi} u(\zeta)\,d\zeta + \frac{\sqrt{1 - 2\beta\, w + \beta^2\underline{X}^2}}{X} \cdot (\tilde{t}_B - \tilde{t}_A) \tag{10}$$

wherein $$\tilde{d}_0 = \frac{d_a}{d_e} \text{ -}$$

ion source geometric factor $+\tilde{i}\ \tilde{t}+\tilde{l}_B = t_B/\tau$, $+\tilde{i}\ \tilde{t}+\tilde{l}_A = t_A/\tau$ The velocity of ions of mass m upon leaving the ion source (at any point B) is shown by Equation 11:

$$v_B = \left(\frac{v_{M_0}}{X}\right)\left[\left(\frac{1-z}{z}\right) \cdot \frac{1}{\tilde{d}_0}\left(\frac{\tilde{t}_B - \tilde{t}_A}{X}\right) + \frac{1}{X\tilde{d}_0 z} \cdot \int_{\tilde{t}_A}^{\tilde{t}_B} u(\zeta)\,d\zeta + \sqrt{1 - 2\beta\, w + \beta^2X}\right] \tag{11}$$

The total flight time, $T_{tof}$, and its scaled value, $\tilde{T}_{tof}/\tau$, including the time of drift through the field-free region of length L, are defined by Equations 12 and 13, respectively:

$$T_{tof} = t_B + \frac{L}{v_B} \tag{12}$$

$$\tilde{T}_{tof} = \frac{T_{tof}}{\tau} = \tilde{t}_B + \frac{\tilde{L}X}{\frac{\tilde{t}_A}{X} + \beta X + \left(\frac{1-z}{z}\right) \cdot \frac{1}{\tilde{d}_0}\left(\frac{\tilde{t}_B - \tilde{t}_A}{X}\right) + \frac{1}{zX\tilde{d}_0}\int_{\tilde{t}_A}^{\tilde{t}_B} u(\zeta')\,d\zeta'} \tag{13}$$

The condition of first-order velocity focusing is defined as the first order derivative of total $T_{tof}$ with respect to initial velocity (or the velocity parameter $\beta$) and is equal to 0. To provide mass range velocity focusing, the result must be valid for ions of all masses ranging from low mass, $m_0$, to high mass, $M_0$, in the mass range of interest. If derivatives are taken of Equations 10 and 13 with respect to the velocity parameter $\beta$ (with both left sides being equal to zero), and if the unknown derivatives $dt_B/d\beta$ are equated in these equations, then an equation is obtained which links the time ions of each mass (with mass being hidden in the X parameter) enter (i e., time A on the time axis) or leave (i e., time B on the time axis) the acceleration region. A corresponding fragment of the correction waveform between these times is shown in Equation 14:

$$\frac{u(\tilde{t}_A)}{ZX}\left(\frac{d\tilde{t}_A}{d\beta}\right)\left[\frac{\tilde{t}_B - \tilde{t}_A}{\tilde{d}_0 \cdot I_0(X, u)} + \frac{X}{\frac{\tilde{d}_0}{\tilde{L}} \cdot I_0^2(X, u) - \frac{1-z}{z} - \frac{u(\tilde{t}_B)}{Z}}\right] = \tag{14}$$

-continued $$\frac{\tilde{d}_0 X^2 - \left(\frac{d\tilde{t}_A}{d\beta}\right)\left(\frac{1-z}{z} - \tilde{d}_0\right)}{\frac{\tilde{d}_0}{\tilde{L}} \cdot I_0^2(X, u) - \frac{1-z}{z} - \frac{u(\tilde{t}_B)}{Z}} - \frac{\left(\frac{d\tilde{t}_A}{d\beta}\right) \cdot \left[\left(\frac{1-z}{z}\right)\frac{1}{\tilde{d}_0}\left(\frac{\tilde{t}_B - \tilde{t}_A}{X}\right) + \left(\frac{\tilde{t}_A}{X} + \beta X\right)\right] - \left(\frac{\tilde{t}_B - \tilde{t}_A}{X}\right) \cdot \left(X^2 + \frac{d\tilde{t}_A}{d\beta}\right)}{I_0(X, u)}$$

wherein:

$$\tilde{L} = \frac{L}{2d_e} \tag{15}$$

$$I_0(X, u) = \left(\frac{1-z}{z}\right)\frac{1}{\tilde{d}_0}\left(\frac{\tilde{t}_B - \tilde{t}_A}{X}\right) + \frac{\tilde{t}_A}{X} + \beta X + \frac{1}{ZX\tilde{d}_0} \cdot \int_{\tilde{t}_A}^{\tilde{t}_B} u(\zeta')\, d\zeta'$$

The calculation of the correction waveform starts from the reference ion mass $M_0$ and the corresponding value of $X_{M0}$ for that mass $M_0$ (see the "reduced mass parameter" for Equation 6). By definition, the time delay is chosen to provide valid first-order focusing conditions exactly for this group of ions. This means that the correction voltage vanishes at the moment ions of mass $M_0$ enter the acceleration region (i.e., $t \geqq t_A(M_0)$). The objective is to derive proper time dependence of the correction potential in the previous time period.

From the fact that $u(\tilde{t}_A)=0$ at $t=t_A(M_0)$ and all subsequent moments (i.e., no corrections after $t_A(M_0)$) it follows that:

$$u(\tilde{t}_A)_{m=M_0} = 0 \quad \int_{\tilde{t}_A}^{\tilde{t}_B} u(\zeta')\, d\zeta' = 0 \tag{16}$$

For ions of lower mass ion $m=M_0-\delta M$ the corresponding instance, that ion enter the acceleration region, precedes that of for an ion $M_0, \tilde{t}_A(m)=\tilde{t}_A(M_0)-\delta\tilde{t}, \delta\tilde{t}>0$.

For these ions of mass $m=M_0-\delta M$ in the vicinity of $M_0$, integrals in Equations 15 and 10 may be replaced by Equations 17 and 18, respectively:

$$\int_{\tilde{t}_A(m)}^{\tilde{t}_B} u(\zeta')\, d\zeta' \underset{m=M_0-\delta M}{=} \frac{\delta\tilde{t}}{2} u(\tilde{t}_A(m)) \tag{17}$$

$$\int_{\tilde{t}_A(m)}^{\tilde{t}_B} d\xi \int_{\tilde{t}_A(m)}^{\xi} u(\zeta')\, d\zeta' \underset{m=M_0-\delta M}{=} \left(\frac{\delta\tilde{t}}{2}\right)^2 u(\tilde{t}_A(m)) \tag{18}$$

Substituting the right sides of Equations 17 and 18 into Equations 10 and 14, respectively, there is a system of two non-linear algebraic equations that are solved numerically, until an accuracy of $10^{-6}$ at each increment of mass is preferably achieved. Each incremented mass is considered, until the whole mass range from $m_0$ to $M_0$ is covered.

Figure 15:
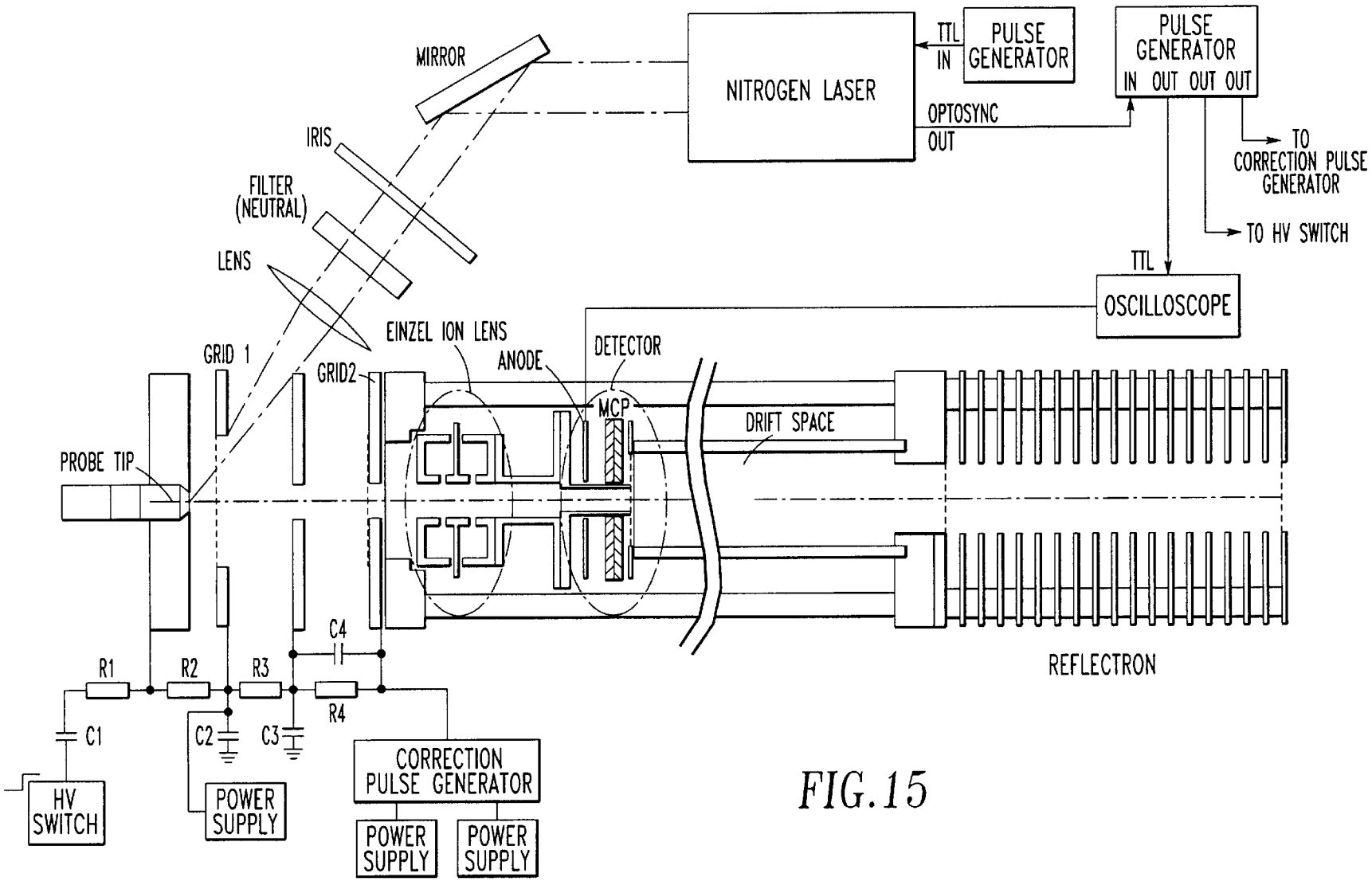
FIG. 15 is a block diagram in schematic form of a reflectron TOF analyzer.

Only minor changes to the analytical procedure are employed for a reflectron-type TOF analyzer (see FIG. 15). For that analyzer, a term $$t_R = \frac{2v_B d_R m}{eU_R} = \tau\left(\frac{z}{z_R}\right) X \tilde{d}_R I_0(X, u),$$

which accounts for the time that an ion spends in the reflector part of the analyzer, is added to the sum in the right side of Equation 12. Here, $U_R$ is the voltage applied across the reflector of length $d_R$, z is the ratio of $U_R$ to the total voltage $U_0$, and $\tilde{d}_R=d_R/d_e$. Formally, $\tilde{L}$ is replaced by:

$$\tilde{L} - 2\left(\frac{z}{z_R}\right)\tilde{d}_R \cdot I_0^2(X, u)$$

in Equation 14. Otherwise, the previous analysis is employed. Although an exemplary reflectron is disclosed, any suitable type (e.g., single, dual-stage, gridless, coaxial, non-linear) may be employed.

Figure 8:
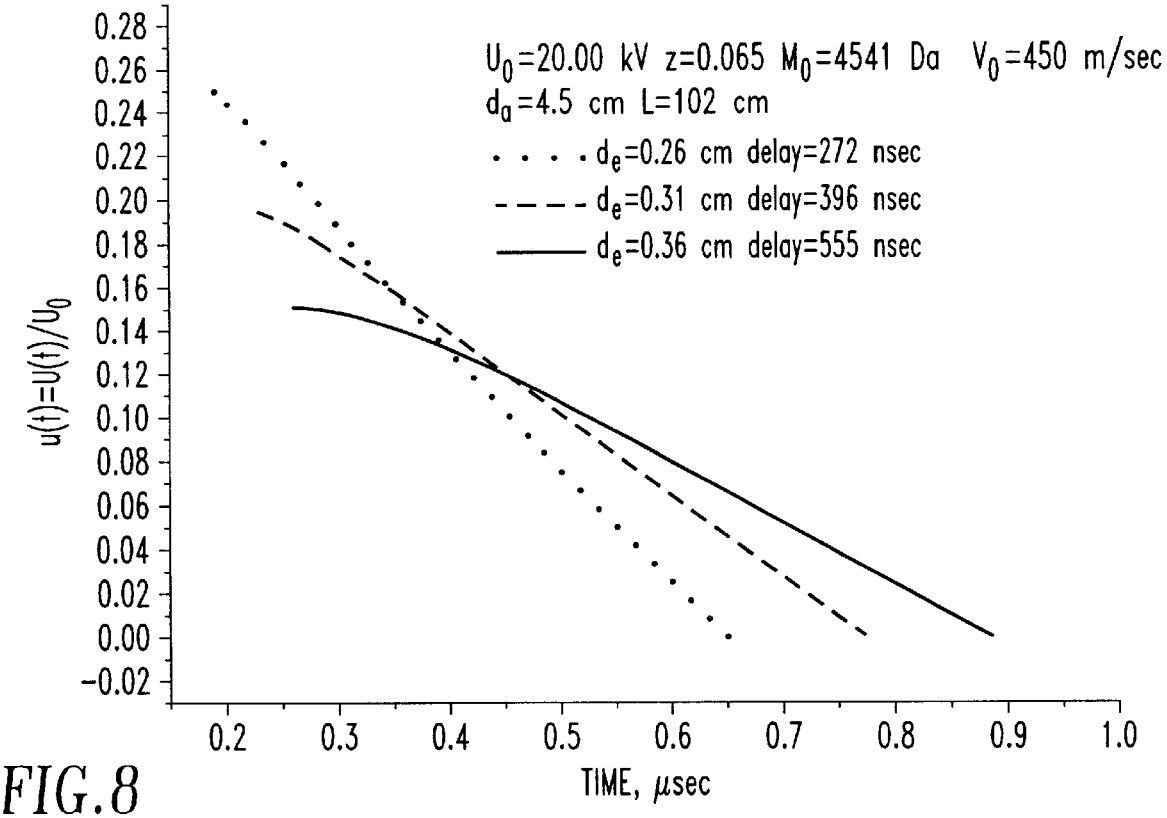
FIG. 8 is a plot of correction voltage versus time in accordance with the present invention in which the length of the extraction region is varied.
Figure 9:
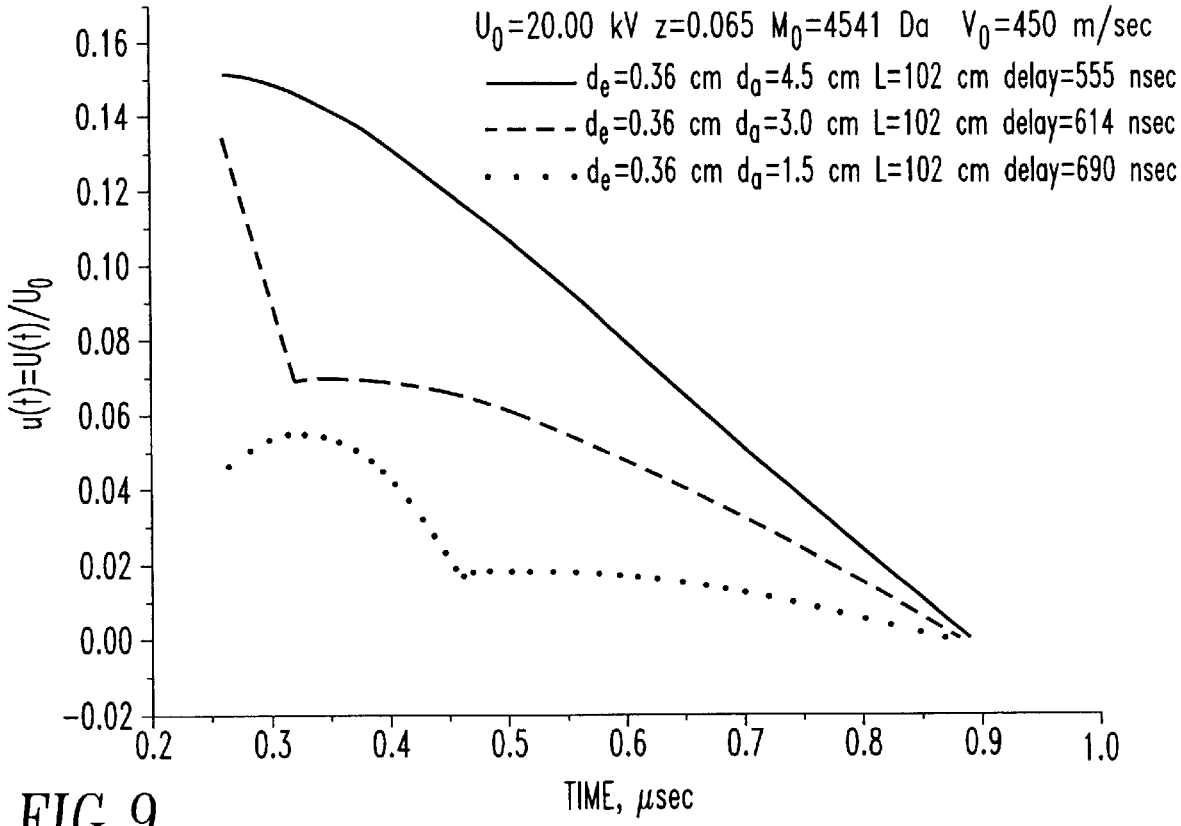
FIG. 9 is a plot of correction voltage versus time in accordance with the present invention in which the length of the acceleration region is varied.
Figure 10:
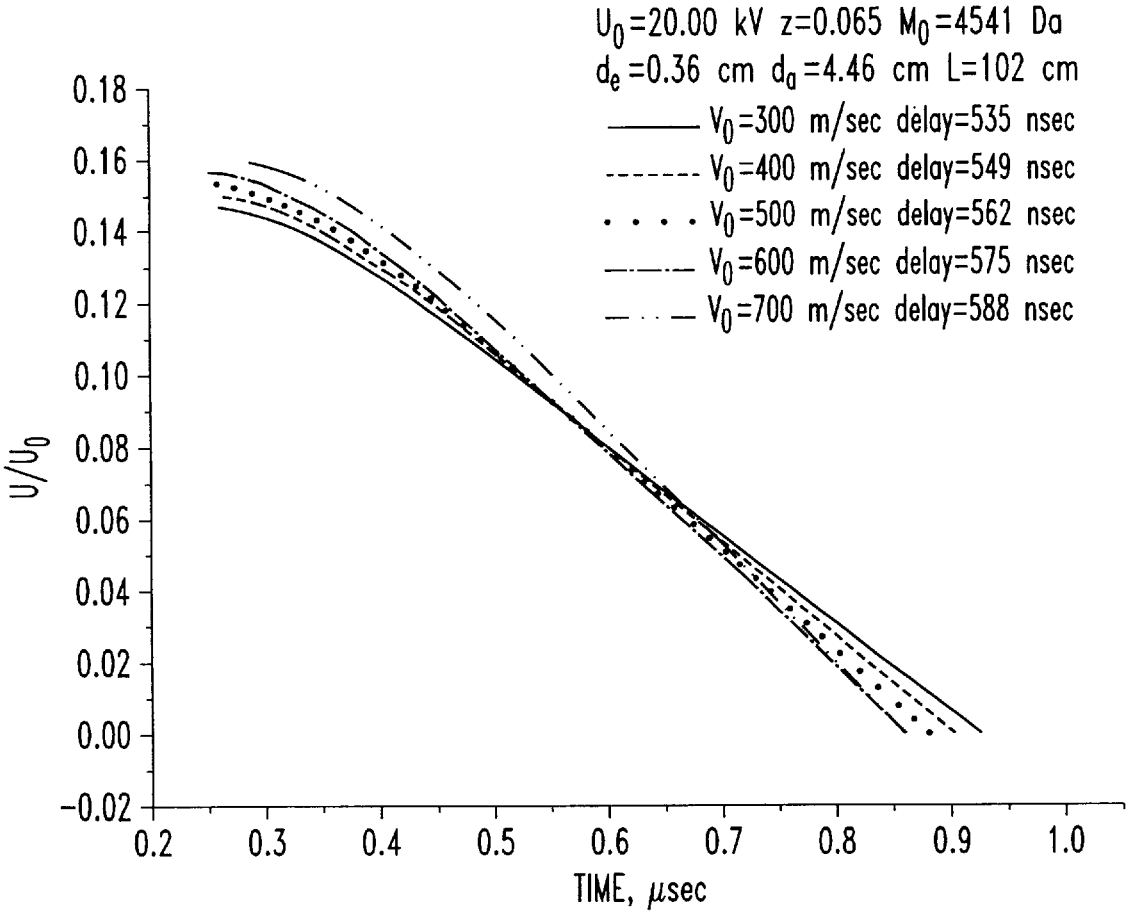
FIG. 10 is a plot of correction voltage versus time in accordance with the present invention in which the approximately known initial velocity of desorbing ions after irradiation is varied.

FIGS. 8–10 show the calculated dependencies of the correction voltage versus time $u(t)=U(t)/U_0$ under various experimental conditions. In FIG. 8, the length $d_e$ of the extraction region is varied, as other exemplary parameters are fixed. In FIG. 9, the length $d_a$ of the acceleration region is varied. In FIG. 10, the single varied parameter is the approximately known initial velocity, $V_0$, of desorbing ions after irradiation. The ratio of $M_0$ to $m_0$ is considered to be about 10 (i.e., a mass range from 450 Da to 4541 Da).

Each choice of geometric parameters has a set of advantages and disadvantages. Selection of a shorter extraction region (see FIG. 8) gives a more linear, but steeper roll-off, of the correction voltage, while the maximum also increases for lower values of $d_e$. Use of a shorter extraction region length $d_e$ results in more severe conditions for space focusing, because the contribution to energy spread from space irregularities may be roughly estimated as $\delta U=\Delta U^*\Delta x/d_e$ where $\Delta x$ is the geometric size of irregularities.

An exemplary length of $d_e$ equal to 3.6 mm. may be employed as a non-limiting compromise value, although other suitable options exist.

For the $d_a$ parameter (see FIG. 9), a choice is made between a maximum pulse amplitude and the feasibility of implementing the desired pulse shape. In order to provide mass-range velocity focusing, thereby covering all the mass range from $m_0$ to $M_0$ (450 to 4541 Da), the preferred choice is the upper (solid) curve, corresponding to $d_a$=4.5 cm. A smaller value of $d_a$ employs lower voltages but provides focusing over a narrower mass range (e.g., for $d_a$=1.5 cm, this ranges from about 1400 to 4541 Da; while for $d_a$=3.0 cm, this ranges from 600 to 4541 Da. If a wide mass range is desired, then $d_a$=4.5 cm may be employed.

FIG. 10 shows the most important source of ambiguity, which is related to poorly known average velocities $V_0$ of desorbing ions for a given matrix. As the value of $V_0$ varies, both the time of correction field turn-off, u(t)=0, and the rate of u(t) roll-off are changed. This is generally the same problem as a search for an optimum time delay in the conventional time-lag focusing method, where the unknown value of $V_0$ affects the calculated delay time. To carry out this procedure, available values of $V_0$ may be employed, or the time ions of mass $M_0$ enter the acceleration region may be established. The latter option may be accomplished by fine tuning delays between the extraction and correction pulses from low to high delay time, until the mass resolution begins to deteriorate. For example, the value of $V_0$ 450 m/s may be employed.

Figure 11:
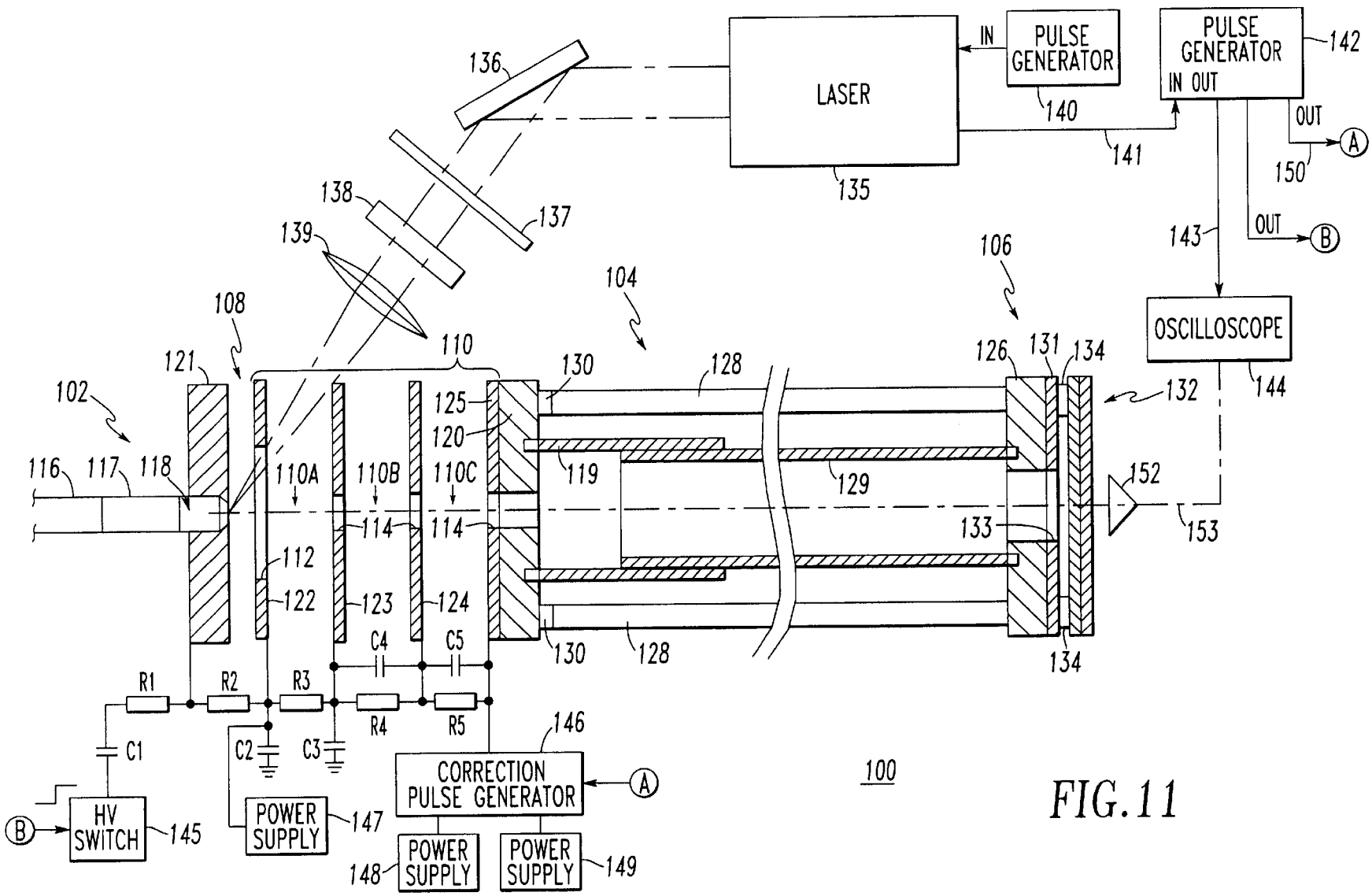
FIG. 11 is a block diagram of a mass spectrometer in accordance with the present invention.

Referring to FIG. 11, an exemplary TOF mass spectrometer 100 includes a dual-stage ion source 102, a field-free drift region 104, and a post-acceleration region 106. The ion source 102 includes an extraction section 108 and an acceleration section 110. The exemplary lengths of the extraction section 108 and acceleration section 110 are 0.364 cm and 4.46 cm, respectively. In order to produce a uniform field distribution through a relatively long acceleration region, the acceleration section 110 is split into three identical subsections 110A, 110B, 110C. The sections 108, 110 are defined by an extraction plate 121, grid 122, separating plates 123,124 and grid 125. The acceleration section 110 employs a voltage divider of three series-connected, low-inductance resistors R3,R4,R5 for the respective subsections 110A, 110B, 110C. The exemplary geometric size of the extraction plate 121, grids 122,125, and separating plates 123,124 is 5.80 cm by 5.80 cm.

The exemplary thickness of the mesh holders (not shown) for the grids 122,125 and the plates 123,124 is 0.60 mm. The first grid 122 has an electroplated Ni mesh of 117 wires per inch which separates the extraction region 108 from the acceleration region 110. The mesh is mounted on the extraction region side of the grid 122. This grid 122 has an exemplary slot opening 112 of 4.0 mm by 16.5 mm, in order to provide laser irradiation of a sample disposed at the probe tip 118, while holding the mesh tightly stretched. The same type of mesh (for the grid 125) is employed to spatially separate the acceleration region 110 from the drift tube space 104. The exemplary diameter of the centered holes 114 which provide transmission of ions in the sub-section electrodes 123,124 and the final mesh-affixed electrode 125 of the ion source 102 is 12.7 mm.

The sample holder or probe is a stainless steel rod 116, having a separating PEEK (polyetheretherketone) isolator 117 and a stainless steel tip 118 where the sample (not shown) is loaded. The position of the tip 118 is preferably precisely aligned with the flat surface parallel to the extraction plate 121 surface, in order to produce a homogeneous electric field in the extraction region 108.

The exemplary length of the drift tube region 104 is 102.05 cm. It is possible to either ground or float the perforated tube 119 (e.g., 38.6 mm diameter) that shields the inner drift tube space from EMI/RF and electrostatic field penetration. An outer perforated tube section may be slid into or out of a narrow slit in the support plate 120 to which the grid 125 is attached. In order to provide strict parallelism of the support plates on the opposite sides of the drift tube, a sturdy frame is employed including two exemplary 10.2 mm thick support plates 120,126 which are held together by four 9.54 mm diameter stainless steel rods 128 of precisely matched length. A perforated tube section 129 on the detector side (i.e., the downstream side) of the drift tube 119 is permanently held on plate 126. The support plate 120 on the opposite side (i.e., the upstream ion source side) of the drift tube 119 may be isolated from the drift tube space by insertion of ceramic spacers 130 between the frame rods 128 and the support plates 120 and by situating a narrow gap (e.g., about 1 mm or less) between the sliding segment of the perforated tube 119 and this plate 120.

To provide post-acceleration of the ions, an additional grid 131 is employed. The drift tube 119 is floated, while the potential at the front plate of the detector 132 is kept constant. This grid 131, having a mesh of 117 wires per inch, has an exemplary 25.44 mm aperture 133. The detector 132 is situated behind the grid 131 and is electrically isolated by ceramic spacers 134. The exemplary distance between the grid 131 and the detector plane, comprising the post-acceleration region 106, is 2.0 mm long. The vacuum chamber (not shown) is pumped by a suitable turbo-pump (not shown), with the pressure in the TOF mass spectrometer 100 preferably kept below $5\times10^{-7}$ Torr.

A suitable pulsed nitrogen laser 135 (e.g., capable of delivering a 300 $\mu$j energy and <4 ns width pulse at peak power of about 75 kW to the sample) is employed as an ionizer. The laser 135 generates a pulse of energy with a duration substantially greater than a time corresponding to required mass resolution. The beam is transmitted onto the sample, passing a flat mirror 136, a variable optical density filter 137, and an iris diaphragm 138. The beam is focused on the target by a suitable UV lens 139 (e.g., having a 75 mm focal length), situated inside the vacuum chamber (not shown). Spectra are recorded at irradiances close to threshold of ion detection or only about 10–15% above. The incidence angle is about 60° with respect to the sample surface normal. The irradiated spot area is about 0.06 $mm^2$ and is imaged by thermal paper.

A suitable pulse generator 140 triggers the laser 135 externally. After he laser 135 fires, a trigger signal 141 from a suitable low-jitter (e.g., <1 ns, 1$\sigma$, typically <500 ps) output is supplied to another suitable pulse generator 142. This four-channel generator 142 provides timing control of the mass spectra measurements. The exemplary delay between the laser output pulse and the output signal 141 is <50 ns, while keeping jitter low. The exemplary propagation delay of the generator 142 (external trigger to output) is 85 ns, jitter <60 ps. Preferably, low jitter is advantageously provided for MALDI TOF mass spectrometers. The pulse generator 142 also provides sync pulses 143 (e.g., 3 ns rise time) to trigger the oscilloscope 144, fast high voltage (HV) switch 145, and correction pulse generator 146.

While for clarity of disclosure reference has been made herein to the exemplary oscilloscope 144 for displaying mass spectra information, it will be appreciated that such information may be stored, printed on hard copy, be computer modified, or be combined with other data. All such processing shall be deemed to fall within the terms "display" or "displaying" as employed herein.

The grid 122 is initially biased at 18.70 kV by HV power supply 147 and the same voltage is applied to the extraction plate 121 through resistor R2. Typically, the extraction plate 121 is pulsed from 18.70 kV to 20 kV by the fast HV switch (pulse amplifier) 145 (e.g., rising edge time of less than 20 ns) after a calculated, optimum time delay for a selected reference mass $M_0$ (i.e., high end of the mass range). The output of the HV switch 145 is connected through a vacuum feedthrough to the extraction plate (electrode) 121 through the series connection of a coupling low-inductance capacitor C1 and a resistor R1. Correction of the applied pulse voltage to the exemplary plate 121 is in the order of about 3% and is employed to account for a voltage drop across the coupling capacitor C1. To prevent flyback voltage spikes on the grid 122 that may originate from both the pulse voltage applied to the extraction plate 121 and, later, from the correction voltage pulse, a ceramic low-inductance capacitor C2 is employed shunt this grid 122.

Figure 12:
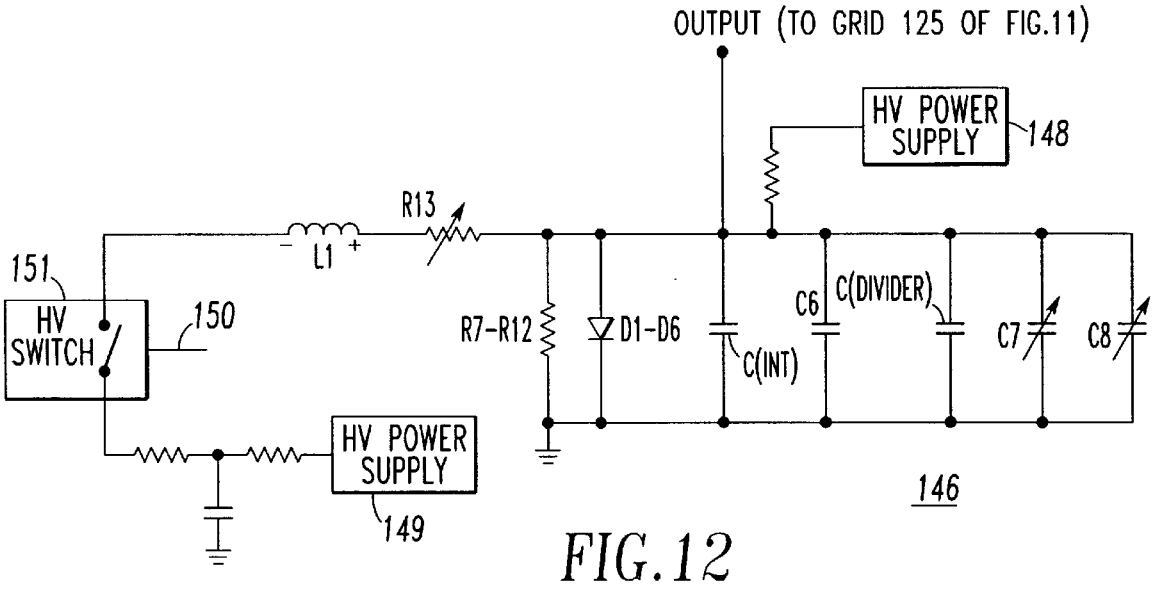
FIG. 12 is a schematic block diagram of a correction pulse generator for the mass spectrometer of FIG. 11.

The electronic circuit of the correction pulse generator 146 is shown in FIG. 12. In order to provide a quasi-ramp waveform correction pulse, a fast HV switch 151 operates in the bipolar mode and switches between two exemplary voltage levels: (1) a low level (start) which is initially biased at about −3350 V by HV power supply 148; and (2) a high level (finish) which is equal to about +8000 V, as supplied by HV power supply 149.

For cut-off, six positive polarity wave clamping fast-recovery diodes D1–D6, each shunted by corresponding resistors R7–R12, are connected parallel to the load (i.e., between grid 125 and ground in FIG. 11). Capacitor C6, variable capacitor C7 (for course adjustment), variable capacitor C8 (for fine adjustment), the intrinsic capacitance of the grid, C(int), and the equivalent capacitance C(divider) of capacitors C3–C5 of FIG. 11, determine two important factors: (1) the total capacitance of the load; and (2) the voltage partition between adjacent sub-sections 110A, 110B, 110C of the acceleration region 110 of FIG. 11. The first factor is important in implementing the true pulse shape, while the second factor contributes to providing a uniform spatial distribution of the correction field. The control signal 150 for the HV switch 151 of the correction pulse generator 146 is output by the pulse generator 142 of FIG. 11.

The correction pulse shape for the series resonance circuit of FIG. 12 is determined by total capacitance; the inductance of the high-frequency, high-current inductor L1; and the value of variable resistor R13. The fine adjustment of the pulse shape is performed by tuning the capacitance of variable HV capacitors C7,C8, the resistance of R13, and, optionally, the value of the second positive level as supplied by HV power supply 149 to the HV switch 151.

Referring again to FIG. 11, a suitable dual micro-channel plate detector 132 having a conical anode 152 and an outer RF/EMI screen (not shown) is employed. The digital oscilloscope 144 records the ion signal 153 from the detector 132. In order to provide better repeatability of spectra, an amplitude discrimination mode is preferably applied, by cutting off inputs above specified upper limits. The exemplary lower limit is set at about 10–40 mV and is dependent upon noise level, while an exemplary higher discrimination level of about 100–200 mV is set just short of saturation of the ion signal. Transfer to a personal computer (PC) (not shown) is accomplished by a suitable commercial software package (e.g., TOFWARE, marketed by Ilys Software). Typically, the ion signals from 30 to 120 individual laser shots, as delivered to a single spot, are averaged. It will be appreciated that while reference has been made to a PC, other processors such as, for example, microcomputers, microprocessors, workstations, minicomputers or mainframe computers may be employed.

Although a time-dependent (and mass-correlated) function is applied to the second extraction region (Uf=−3.2 kV to about 0 V) of FIG. 7, it will be appreciated that equivalent electric fields for the extraction region 108 and acceleration region 110 of FIG. 11 may be provided by grounding the grid 125 (Uf =0 V) and applying a time-dependent (and mass-correlated) function to both of the source or extraction plate 121 (e.g., Ue=21.9 kV to 23.2 kV to 20 kV) and the intermediate grid or grid 122 (e.g., Ua=21.9 kV to about 18.7 kV).

A reflectron TOF analyzer is shown in FIG. 15. Compared to a linear design, a relatively shorter second region of the ion source is employed (e.g., 3.10 cm instead of 4.46 cm). An Einzel lens assembly is added and positioned at the exit of the ion source. An exemplary reflectron section of 29.1 cm is mounted at the end of a shortened drift tube. The total ion drift path in this exemplary arrangement is 120.2 cm. An exemplary coaxial Hamamatsu MCP detector (model F4294-09) with a 6 mm central hole is employed for ion detection. The exemplary reflectron assembly contains a stack of 7.0 by 7.0 cm rectangular plates, with a 40 mm central hole, separated by ceramic spacers, each of which is 6.43 mm long. The total length of the exemplary reflector is 29.1 cm.

Figure 13:
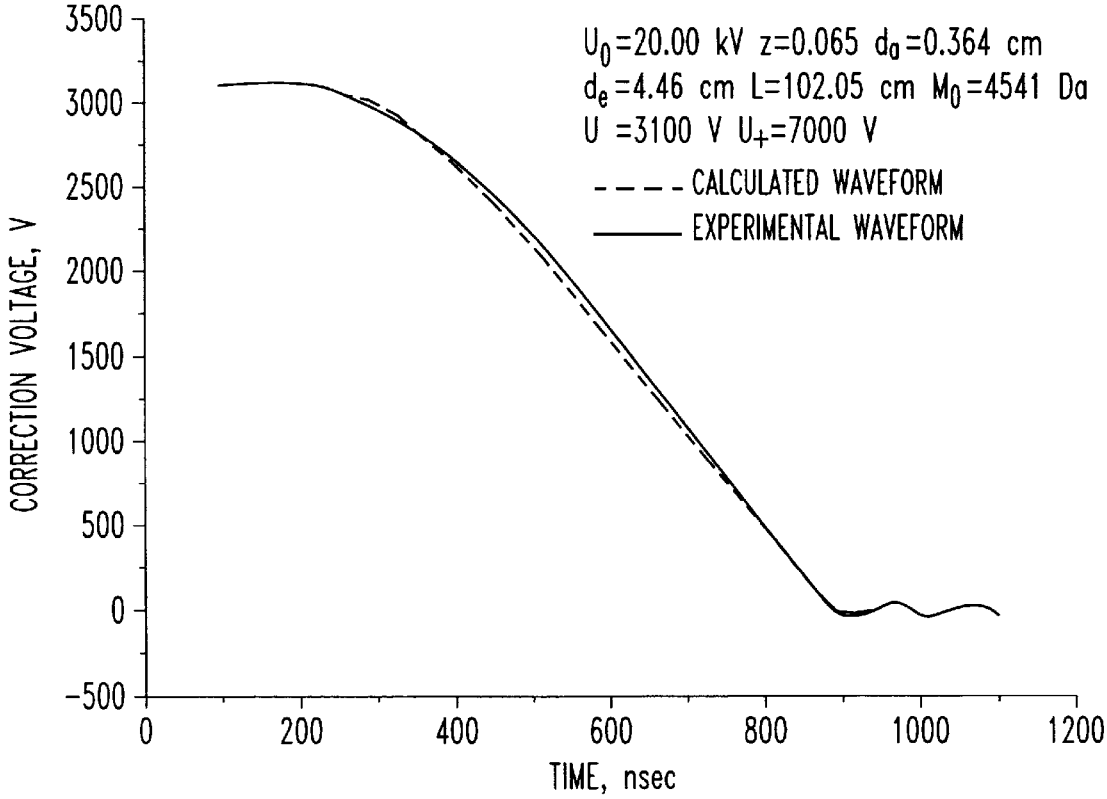
FIG. 13 is a plot of theoretical and experimental pulse waveforms in accordance with the present invention.

Referring to FIG. 13, a theoretical waveform (dashed line) is shown for a linear instrument assuming $V_0$=450 m/s is the average velocity of desorbing ions. The time delay between the laser pulse and the extraction pulse is set to 555 ns, which, for the experimental parameters disclosed above, corresponds to focusing of $MH^+$=4542 Da ions at the high-mass end. The time t=0 is taken to be the onset of acceleration. A significant portion of a voltage function within the time frame from about 470 to 880 ns could be well fitted by a decreasing linear function, thereafter the correction voltage is switched off. This linear part of the correction voltage corresponds to the period when ions within a mass window from 1200 to 4542 Da enter the acceleration region and are subjected to the combined effect of constant and time-dependent electric fields. The initial portion of the voltage function, taking part in correction for lighter ions $MH^+$<1200 Da, indicates a more complex shape.

FIG. 13 shows the experimental waveform (solid line) generated by the exemplary correction pulse generator. Pulse polarity is negative if applied to the second acceleration grid. A close match of the calculated and experimental voltages is achieved, since the difference between these voltages does not exceed 3% in the middle portion of the waveforms and the curves are fairly close in the earlier t<360 ns and the later 880 ns>t>760 ns period. Nevertheless, there is a noticeable ringing after the time the correction voltage drops to zero. This may potentially affect the mass resolution, especially for heavier ions close to the high mass end.

Before the experimental test, it is highly desirable to have an alternative confirmation of the method and, also, to examine the appropriateness of different type waveforms that may easily be implemented. A simulation model of the experimental set-up with a correction time-dependent voltage function included is tested employing SIMION 3D v.6 software (Princeton Electronic Systems, Inc., Princeton, N.J. 08543). To model conditions with both a static and a time-varying field applied, an algorithm is generated. For example, one case includes a linear voltage function applied to the second grid of the acceleration region with a time rate of −5.28 kV/$\mu$s, terminated after t 880 ns. The time delay between the laser pulse and ion extraction is set to 555 ns. Static voltages and geometry parameters used in the simulation are identical to those in the experimental set-up. Because of a large uncertainty in initial velocity distribution of desorbing ions, ion velocities are assumed to range from 150 to 750 m/s for each iso-mass packet. In the simulation, a broad mass range from 574 to 4542 Da is covered.

Table 1 shows a comparison of the simulated flight times in a linear TOF instrument for different mass ions using a standard pulsed extraction as compared to when a correction is applied. In Table 1, the calculated time-of-flight values are shown and, also, dispersion of arrival times is referred to as a time spread. Both data sets, with a correction voltage applied and normal pulsed extraction mode (without correction), are modeled. The effect of correction on mass resolution is unambiguously seen by comparing the time spread for ions within an iso-mass packet. For ion packets of mass 4542 and 4183 Da, the difference between modes is quite small, but mass resolution is fairly appropriate, since the pulse extraction method itself provides good energy focusing in a narrow mass range.

From $MH^+$=3820 Da to low masses, the effect of correction becomes clearly pronounced. Down to 574 Da (the low mass end), the time spread within the iso-mass packet does not exceed 3 ns in the correction mode, while it is increased with mass almost monotonically from 8 to 21 ns in the normal mode. Focusing of the lowest mass $MH^+$=574 Da ions employs a correction pulse waveform that is substantially deviated from a simple linear U(t) dependence.

Nevertheless, the correction using a simple linear waveform is still quite appropriate.

Figure 14A:
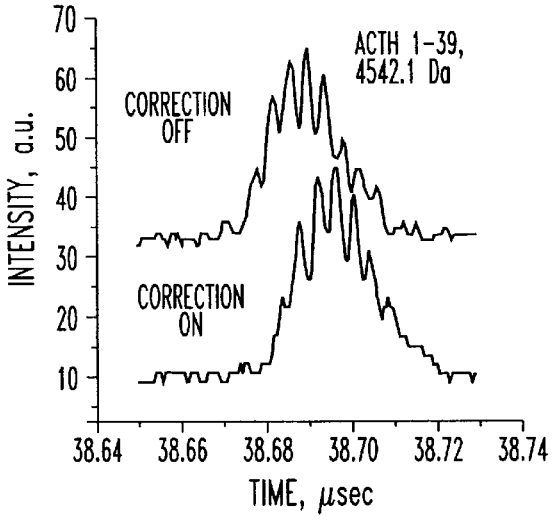
FIGS. 14A–14L are plots of mass spectra for various peptides with and without mass-correlated extraction.
Figure 14B:
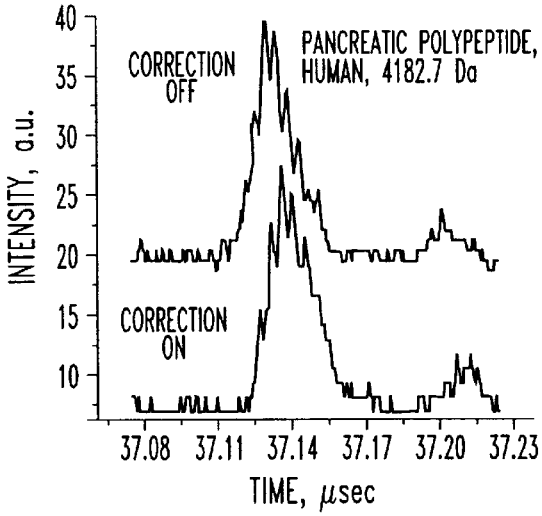
Figure 14C:
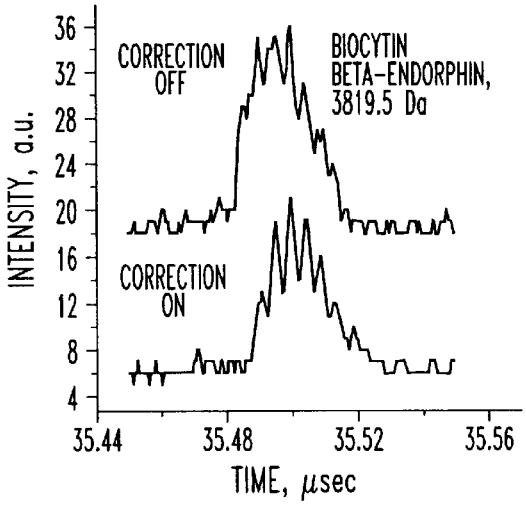
Figure 14D:
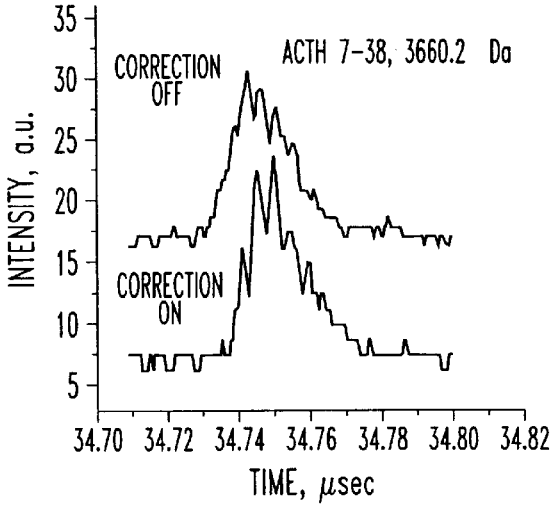
Figure 14E:
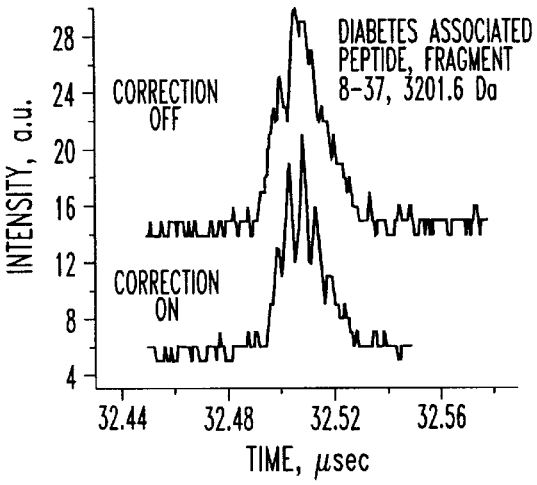
Figure 14F:
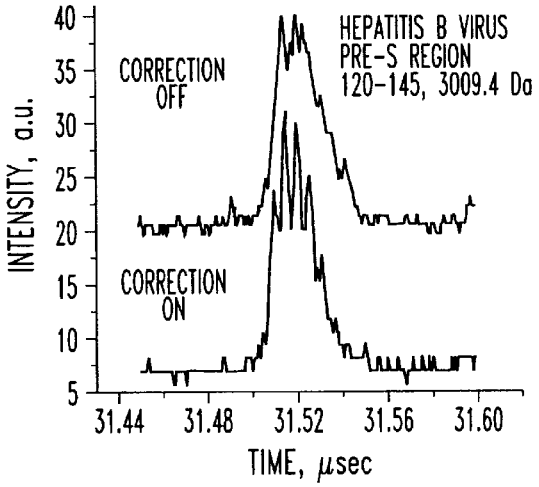
Figure 14G:
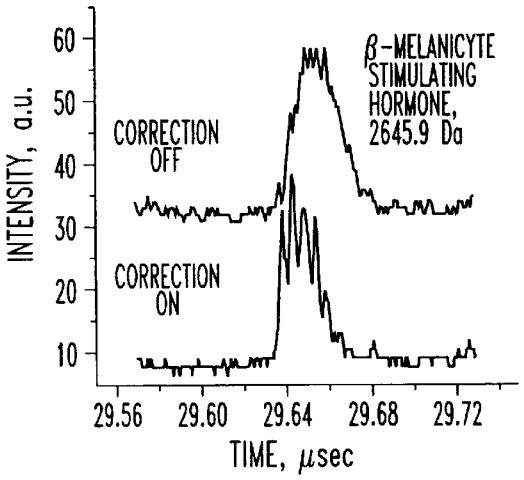
Figure 14H:
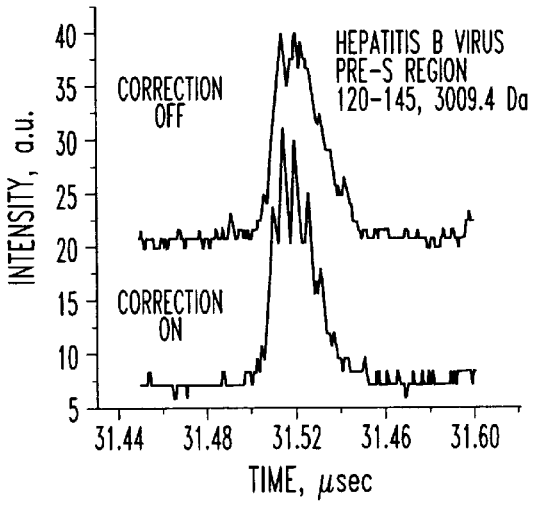
Figure 14I:
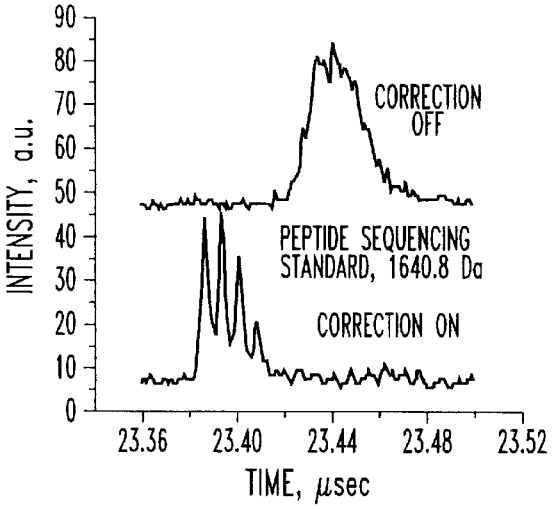
Figure 14J:
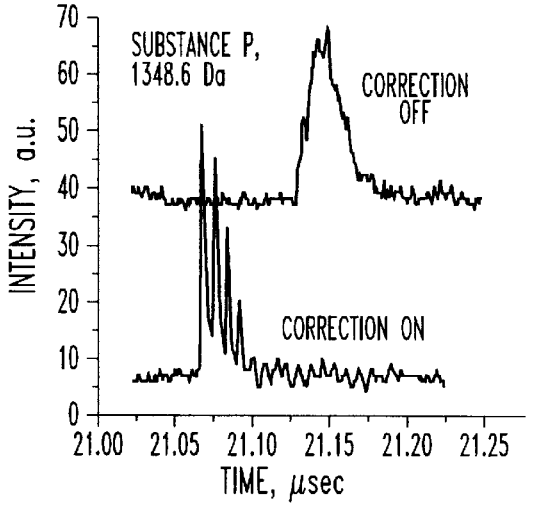
Figure 14K:
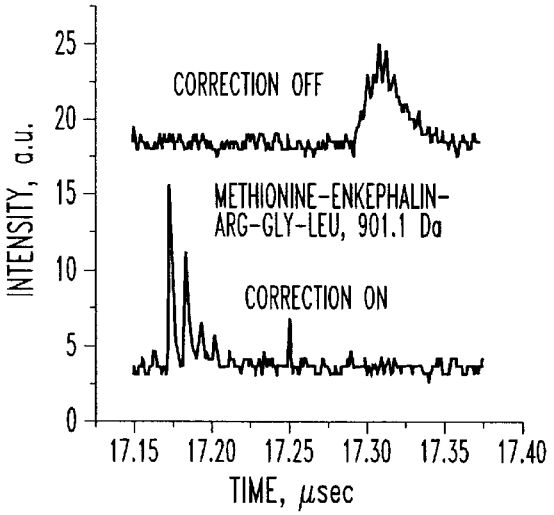
Figure 14L:
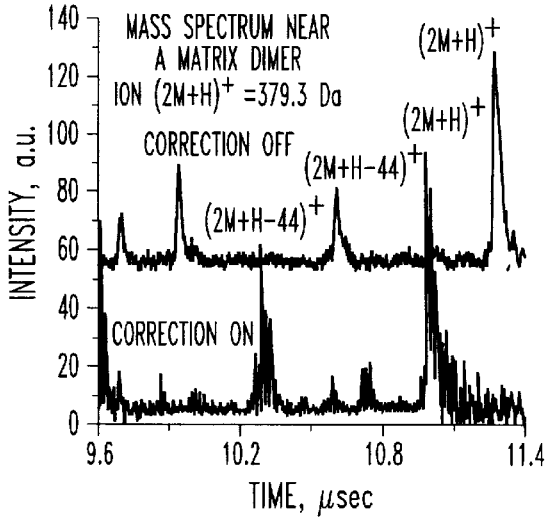

The results of the experimental verification of the method on the linear TOF analyzer are shown in FIGS. 14A–14R. In close agreement with SIMION simulation, both correction and normal mode give nealry identical peak shapes for ions in the mass range from 4542 Da, the high mass end, down to mass of 4183 Da. With a correction voltage applied, a substantial improvement is observed in mass resolution for lighter ions $MH^+$<3820 Da, obtained in the same mass spectrum.

Table 3 shows a comparison of experimental values of mass resolution for individual peptides in two operational modes: with pulse correction and in standard pulsed extraction mode. In Table 3, "–". refers to spectra without a distinctive isotopic pattern. For lower mass ions, the isotopic pattern is barely seen in the normal pulsed extraction mode, while with a correction, all peaks are isotopically resolved with high mass resolution, as summarized in Table 3. Throughout the entire range of ion mass from 901 to 4542 Da mass resolution, as determined by FWHM criteria (full width at half maximum), there are values in the range from 4500 to 7800 Da. In the normal mode, a distinctive isotopic pattern is observed only for two higher ion masses, 4542 and 4183 Da, followed by unresolved peaks for lower mass ions, which is quite in agreement with the pulse extraction theory.

A distinct isotopic pattern is observed even beyond the low mass limit (about 450 Da) for which a correction pulse was generated. This is due to the mass range near the peaks of matrix dimer ions of mass $[2M+H]^+$=379 Da and $[2M+H-\mathbf{44}]^+$. In addition to the isotopic pattern of the last peak, several contributions to the local spectrum occur, while in the normal mode this information is hidden. This demonstrates that with a mass-correlated pulsed extraction mode applied to a linear TOF instrument, the entire range of mass from 335 to 4542 Da is effectively covered with much better than unit mass resolution.

The reflectron mode of TOF instrument with a correction option included is also tested experimentally. The calculated voltage function for a reflectron analyzer is substantially different from a linear waveform. Its shape takes a form of an asymmetrical bell.

Figure 16A:
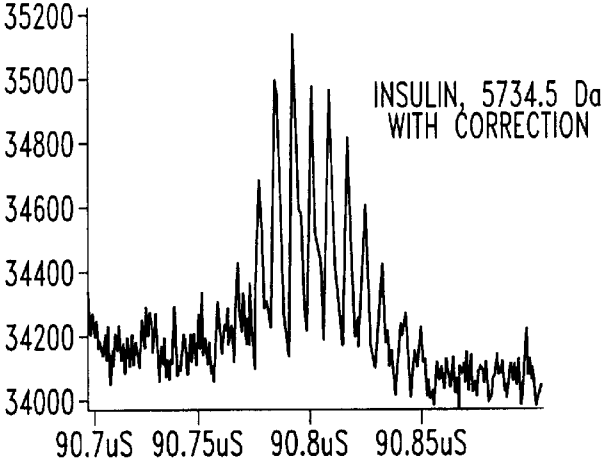
FIGS. 16A–16R are plots showing mass spectra for the mixture of various peptides as obtained with mass-correlated extraction employing the reflectron TOF analyzer of FIG. 15.
Figure 16B:
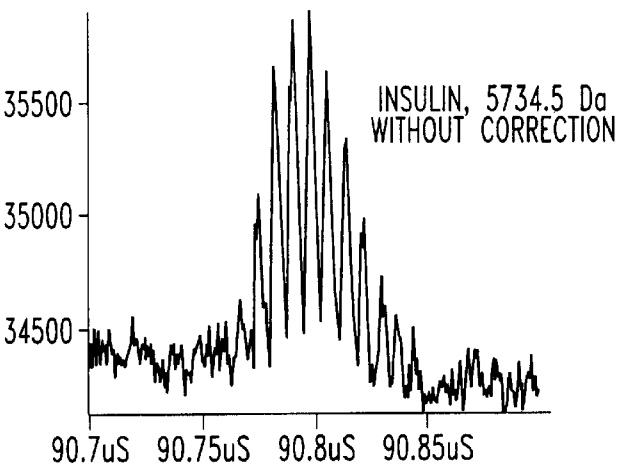
Figure 16C:
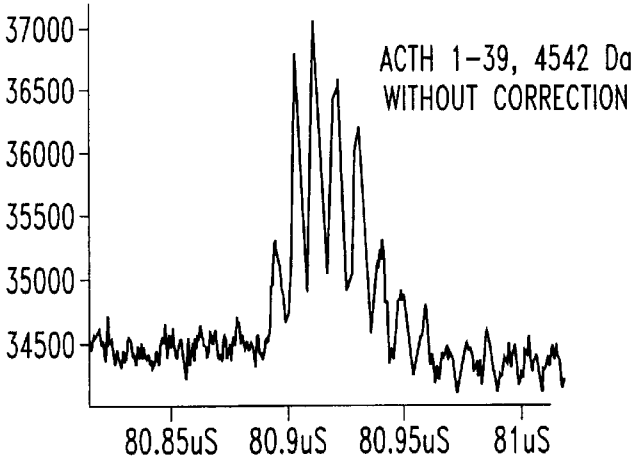
Figure 16D:
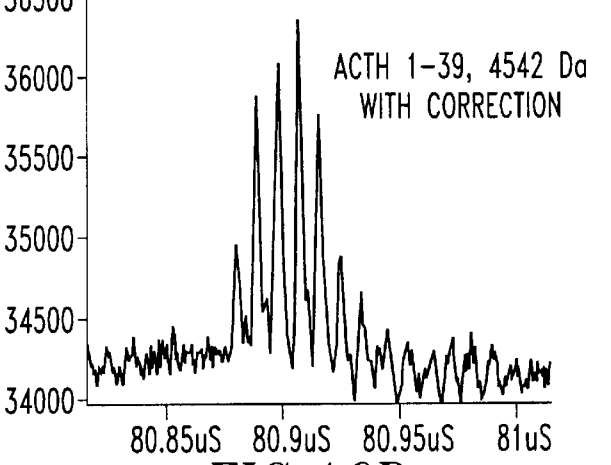
Figure 16J:
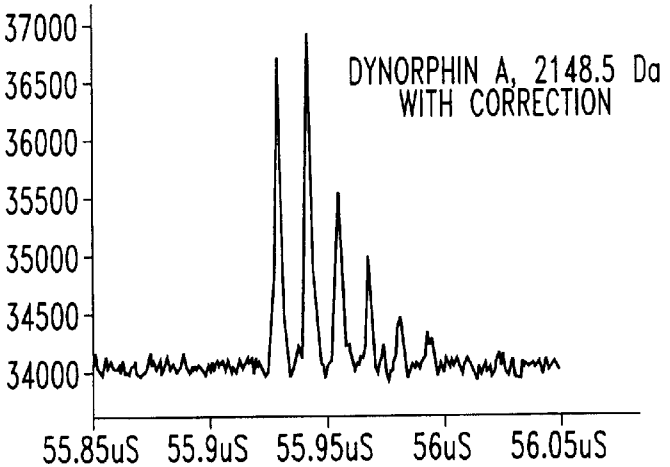
Figure 16I:
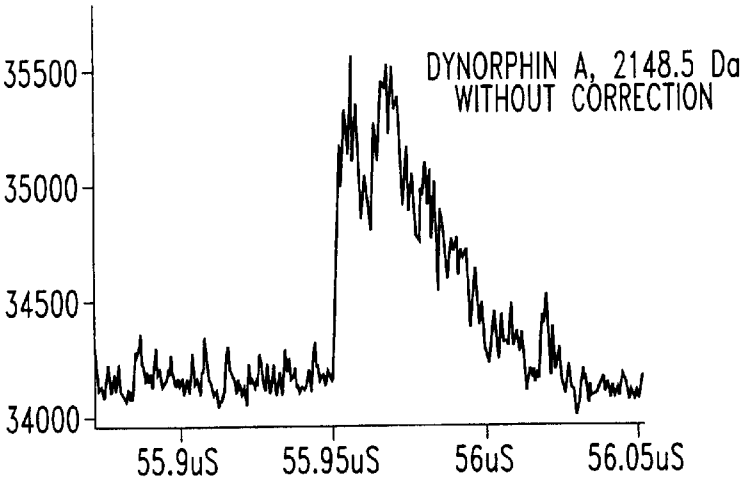
Figure 16L:
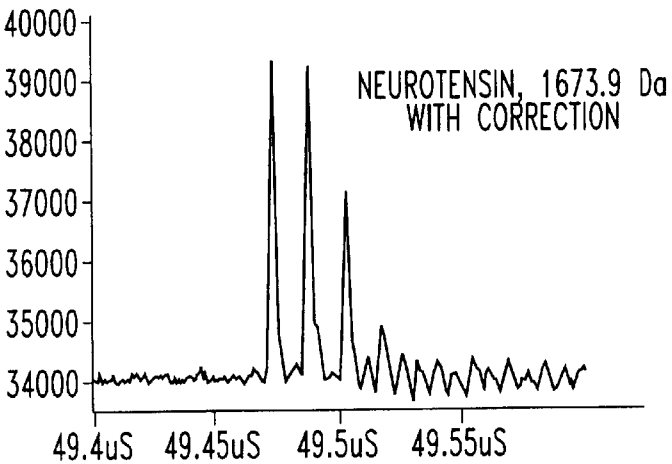
Figure 16K:
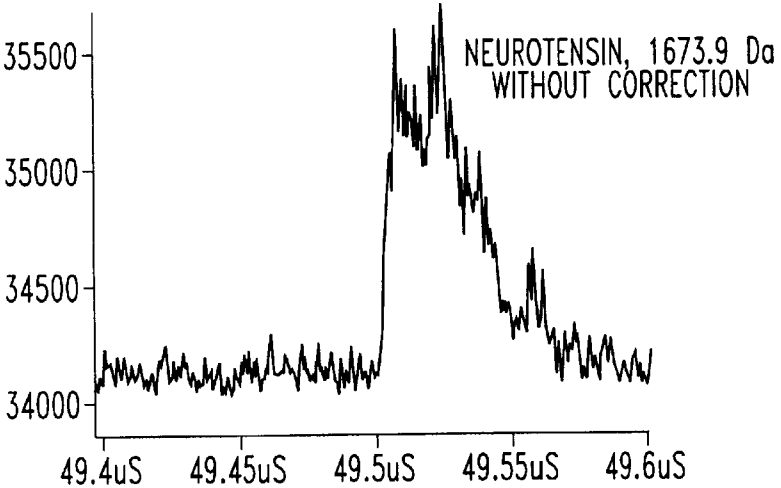
Figure 16M:
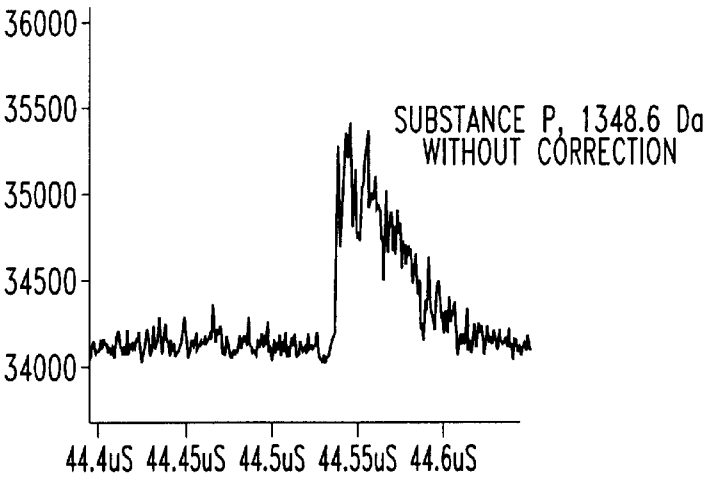
Figure 16N:
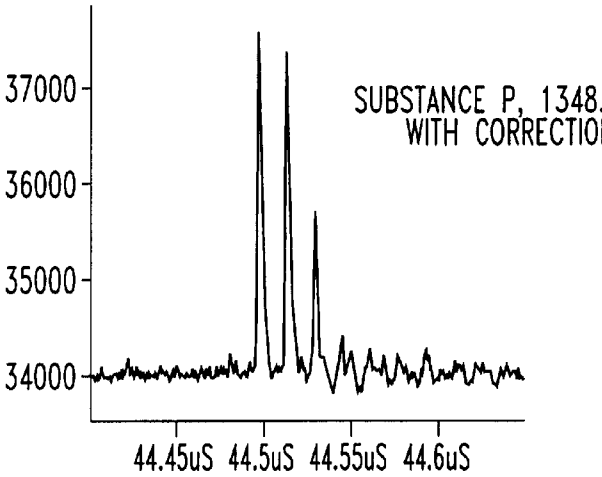
Figure 16O:
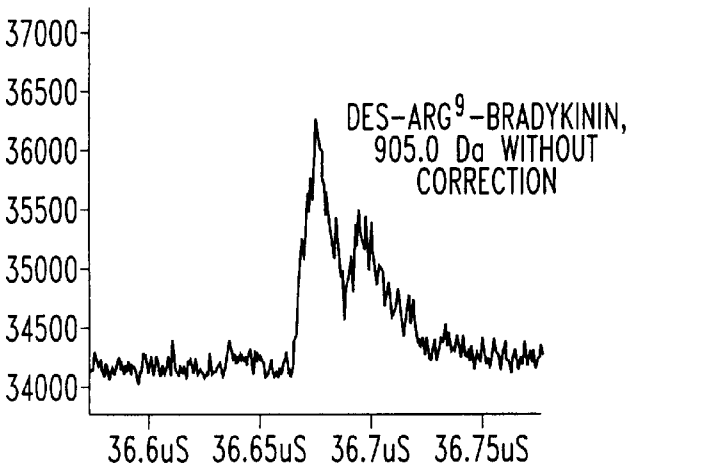
Figure 16P:
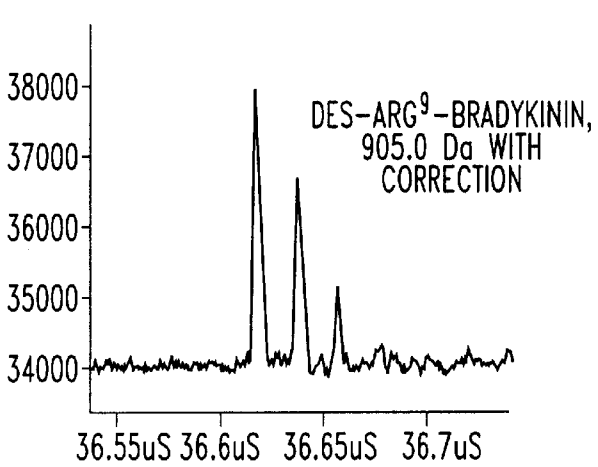
Figure 16Q:
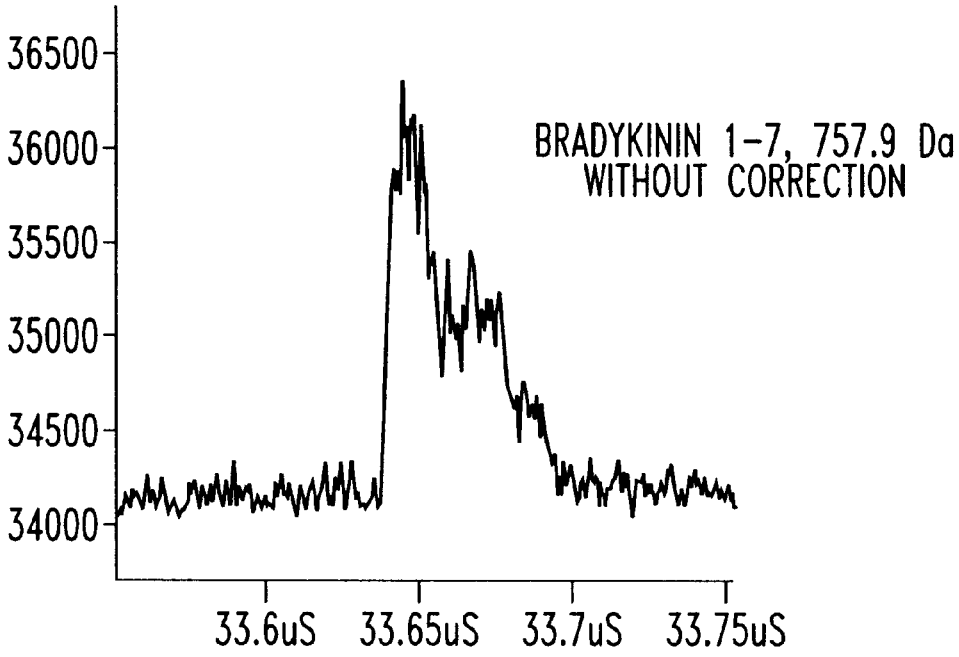
Figure 16R:
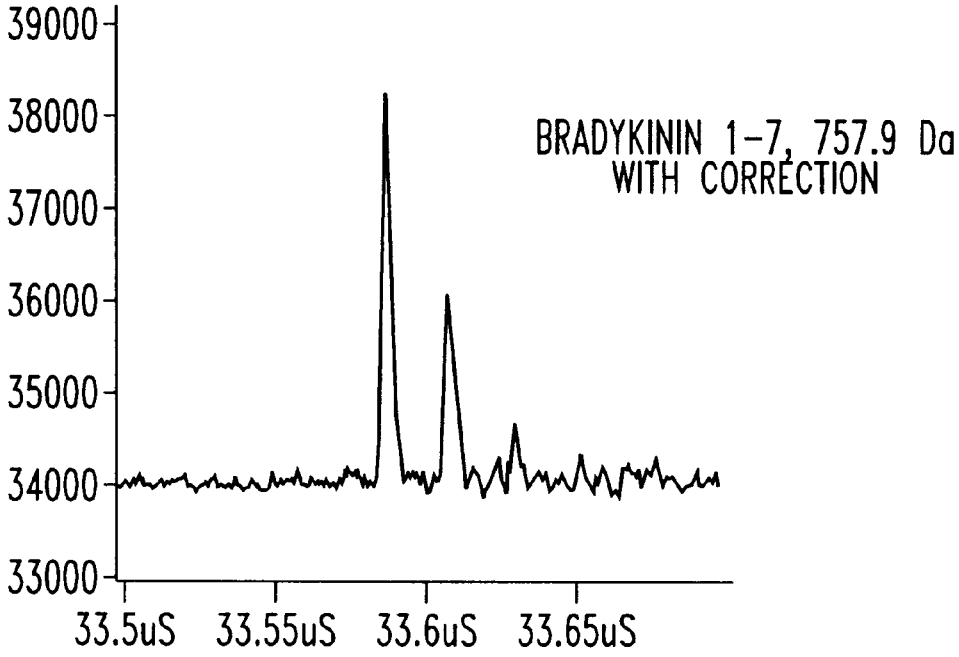

Experimental mass spectra (reflectron mode) or the mixture of nine peptides (without correction and with correction) of Table 2 are shown in FIGS. 16A–16R. The mass-correlated pulsed extraction method outperforms the normal mode already at $MH^+$=4542 Da, which is only 20% off the high-mass end. For lower ion masses, the effect becomes even more pronounced.

The advantages of mass-correlated pulse extraction manifest themselves in quite uniform distributions of mass resolution over a wide mass range. For a further improvement of the performance of the method, more detailed information about initial velocity distribution for different mass ions may be employed. Preferably, a circuit design which includes eliminating ringing and closer fitting to a theoretical waveform promotes the achievement of a higher mass resolution.

Although exemplary grids, such as 122,125 of FIG. 11, are disclosed herein, the present invention is applicable to equivalent structures such as, for example, electrostatic lenses.

TABLE 1

| Velocity, m/s | TOF, μs correction | TOF, μs standard | TOF, μs correction | TOF, μs standard | TOF, μs correction | TOF, μs standard |
|---|---|---|---|---|---|---|
| | $MH^+$ = 4542.1 Da | | $MH^+$ = 4182.7 Da | | $MH^+$ = 3819.5 Da | |
| 150 | 38.969 | 38.969 | 37.419 | 37.419 | 35.780 | 35.780 |
| 300 | 38.970 | 38.970 | 37.420 | 37.422 | 35.781 | 35.782 |
| 450 | 38.971 | 38.971 | 37.423 | 37.423 | 35.783 | 35.785 |
| 600 | 38.970 | 38.970 | 37.423 | 37.424 | 35.782 | 35.787 |
| 750 | 38.968 | 38.969 | 37.420 | 37.424 | 35.780 | 35.788 |
| Time spread, ns | 3 | 2 | 4 | 5 | 3 | 8 |
| | $MH^+$ = 3660.2 Da | | $MH^+$ = 3201.6 Da | | $MH^+$ = 3009.4 Da | |
| 150 | 35.039 | 35.039 | 32.795 | 32.799 | 31.815 | 31.822 |
| 300 | 35.040 | 35.042 | 32.798 | 32.804 | 31.818 | 31.827 |
| 450 | 35.041 | 35.044 | 32.798 | 32.807 | 31.818 | 31.830 |
| 600 | 35.040 | 35.042 | 32.798 | 32.811 | 31.818 | 31.834 |
| 750 | 35.040 | 35.048 | 32.797 | 32.813 | 31.818 | 31.838 |
| Time spread, ns | 2 | 9 | 3 | 14 | 3 | 16 |
| | $MH^+$ = 2645.9 Da | | $MH^+$ = 2149.4 Da | | $MH^+$ = 1640.8 Da | |
| 150 | 29.947 | 29.960 | 26.951 | 26.980 | 23.584 | 23.639 |
| 300 | 29.948 | 29.964 | 26.953 | 26.985 | 23.586 | 23.645 |
| 450 | 29.949 | 29.969 | 26.952 | 26.990 | 23.585 | 23.650 |
| 600 | 29.947 | 29.973 | 26.954 | 26.996 | 23.587 | 23.656 |
| 750 | 29.948 | 29.977 | 26.953 | 27.000 | 23.586 | 23.661 |
| Time spread, ns | 2 | 17 | 3 | 20 | 3 | 22 |
| | $MH^+$ = 1348.6 Da | | $MH^+$ = 901.1 Da | | $MH^+$ = 573.7 Da | |
| 150 | 21.413 | 21.490 | 17.532 | 17.664 | 14.004 | 14.210 |
| 300 | 21.415 | 21.497 | 17.532 | 17.670 | 14.002 | 14.215 |
| 450 | 21.416 | 21.503 | 17.533 | 17.676 | 14.004 | 14.221 |
| 600 | 21.415 | 21.508 | 17.532 | 17.681 | 14.004 | 14.226 |
| 750 | 21.416 | 21.514 | 17.535 | 17.688 | 14.002 | 14.231 |
| Time spread, ns | 3 | 24 | 3 | 24 | 3 | 21 |

TABLE 2

| | Molecular weight (Da) |
|---|---|
| Linear mode of TOF MS | |
| 1. Adrenocorticotropic hormone, fragment 1-39 | 4541.1 |
| 2. Pancreatic polypeptide | 4181.7 |
| 3. Biocytin-β-endorphin | 3818.5 |
| 4. Adrenocorticotropic hormone, fragment 7-38 | 3659.2 |
| 5. Hepatitis B, pre-S region, fragment 120-145 | 3008.4 |
| 6. Diabetes associated peptide amide, fragment 8-37 | 3200.6 |
| 7. β-melanocyte stimulating hormone | 2644.9 |
| 8. Parathyroid hormone, fragment 28-48 | 2148.4 |
| 9. Peptide sequencing standard | 1639.8 |
| 10. Substance P | 1347.6 |
| 11. Methionine enkephalin - Arg-Gly-Leu | 900.1 |
| Reflectron mode of TOF MS | |
| 1. Insulin (bovine) | 5733.5 |
| 2. Adrenocorticotropic hormone, fragment 1-39 | 4541.1 |
| 3. Adrenocorticotropic hormone, fragment 7-38 | 3660.2 |
| 4. Somatostatin 28 | 3149.6 |
| 5. Dynorphin A | 2148.5 |
| 6. Neurotensin | 1673.9 |
| 7. Substance P | 1347.6 |
| 8. des-Arg$^9$-bradykinin | 905.0 |
| 9. Bradykinin, fragment 1-7 | 755.9 |

TABLE 3

| Peptide | $MH^+$, Da | With correction | Standard pulsed extraction |
|---|---|---|---|
| ACTH, fragment 1-39 | 4542.1 | 7800 | 7800 |
| Pancreatic polypeptide | 4182.7 | 5770 | 5900 |
| Biocytin β-endorphin | 3819.5 | 6950 | — |
| ACTH, fragment 7-38 | 3660.2 | 6300 | — |
| Diabetes associated peptide amide, fragment 8-37 | 3201.6 | 6800 | — |
| Hepatitis B, pre-S region, fragment 120-145 | 3009.4 | 5500 | — |
| β-melanocyte stimulating hormone | 2645.9 | 5700 | — |
| Parathyroid hormone, fragment 28-48 | 2149.4 | 5950 | — |
| Peptide sequencing standard | 1640.8 | 4600 | — |
| Substance P | 1348.6 | 4600 | — |
| Methionine-Enkephalin-Arg-Gly-Leu | 901.1 | 4700 | — |

Whereas particular embodiments of the present invention have been described above for purposes of illustration, it will be appreciated by those skilled in the art that numerous variations in the details may be made without departing from the invention as described in the claims which are appended hereto.

We claim:

1. A time-of-flight mass spectrometer comprising:

a sample holder for a sample;

an ionizer for ionizing the sample to form ions;

a first element spaced downstream from said sample holder;

a second element spaced downstream from said first element;

a drift region downstream of said second element;

means for establishing an electric field between said sample holder and said first element at a time subsequent to ionizing the sample in order to extract the ions;

means for establishing a time-dependent and mass-correlated electric field between at least one of: (a) said first element and said second element, and (b) said sample holder and said first element; and means for detecting the ions.

2. The mass spectrometer of claim 1 wherein said ions include a first ion having a mass and a first velocity and a second ion having said mass and a second velocity, with said first velocity being different than said second velocity; and wherein said means for establishing a time-dependent and mass-correlated electric field compensates for the difference between said first and second velocities.

3. The mass spectrometer of claim 2 wherein said means for establishing a time-dependent and mass-correlated electric field includes means for establishing said time-dependent and mass-correlated electric field between said first element and said second element.

4. The mass spectrometer of claim 2 wherein said means for establishing a time-dependent and mass-correlated electric field includes means for establishing said time-dependent and mass-correlated electric field between said sample holder and said first element.

5. The mass spectrometer of claim 3 wherein said mass is a first mass; wherein said ions further include a third ion having a second mass, with said second mass being greater than said first mass; and wherein said means for establishing a time-dependent and mass-correlated electric field provides no compensation for said third ion when said second mass is greater than or equal to a predetermined mass.

6. The mass spectrometer of claim 4 wherein said mass is a first mass; wherein said ions further include a third ion having a second mass, with said second mass being less than said first mass; and wherein said means for establishing a time-dependent and mass-correlated electric field provides no compensation for said third ion when said second mass is less than or equal to a predetermined mass.

7. The mass spectrometer of claim 1 wherein said ionizer is a laser which generates a pulse of energy with a duration substantially greater than a time corresponding to required mass resolution.

8. The mass spectrometer of claim 1 wherein said first element comprises a grid.

9. The mass spectrometer of claim 1 wherein said second element comprises a grid.

10. The mass spectrometer of claim 1 wherein said first element comprises an electrostatic lens.

11. The mass spectrometer of claim 1 wherein said second element comprises an electrostatic lens.

12. The mass spectrometer of claim 1 wherein said ions include a first ion having a first mass and a first velocity; a second ion having said first mass and a second velocity, with said first velocity being different than said second velocity, a third ion having a second mass and a third velocity, and a fourth ion having said second mass and a fourth velocity, with said third velocity being different than said fourth velocity, with said first mass being less than said second mass, and with said first and second velocities being greater than said third and fourth velocities; and wherein said means for establishing a time-dependent and mass-correlated electric field compensates for the difference between said first and second velocities, and for the difference between said third and fourth velocities.

13. A time-of-flight mass spectrometer comprising:

a sample holder for a sample;

an ionizer for ionizing the sample to form ions;

a first element spaced downstream from said sample holder;

a second element spaced downstream from said first element;

a drift region downstream of said second element;

a power source electrically coupled to said first element for applying a constant first voltage thereto;

means electrically coupled to said sample holder for applying said first voltage thereto for a time subsequent to ionizing the sample, and for applying a second voltage, which is different than said first voltage, after said time in order to extract the ions;

means electrically coupled to said second element for applying a time-dependent and mass-correlated voltage thereto; and means for detecting the ions.

14. The spectrometer of claim 13 wherein said means electrically coupled to said sample holder applies a positive going pulse to said sample holder.

15. The spectrometer of claim 14 wherein said means electrically coupled to said sample holder applies said first voltage of about 18.7 kV and said second voltage of about 20.0 kV.

16. The spectrometer of claim 14 wherein said power source electrically coupled to said first element applies said first voltage of about 18.7 kV.

17. The spectrometer of claim 13 wherein said means electrically coupled to said second element applies a third voltage for a time subsequent to ionizing the sample and then applies said time-dependent and mass-correlated voltage.

18. The spectrometer of claim 17 wherein said means electrically coupled to said sample holder applies said first voltage thereto for a first time subsequent to ionizing the sample; and wherein said means electrically coupled to said second element applies said third voltage for a second time subsequent to ionizing the sample.

19. The spectrometer of claim 17 wherein said third voltage is about −3.2 kV for said second time subsequent to ionizing the sample.

20. The spectrometer of claim 17 wherein said means electrically coupled to said second element applies a voltage which increases with time from said third voltage to a fourth voltage in order to apply said time-dependent and mass-correlated voltage.

21. The spectrometer of claim 20 wherein said third voltage is about −3.2 kV; and wherein said fourth voltage is about 0 V.

22. The mass spectrometer of claim 13 wherein said ionizer is a laser which generates a pulse of energy with a duration substantially greater than a time corresponding to required mass resolution.

23. The mass spectrometer of claim 13 wherein said first element comprises a grid.

24. The mass spectrometer of claim 13 wherein said second element comprises a grid.

25. The mass spectrometer of claim 13 wherein said first element comprises an electrostatic lens.

26. The mass spectrometer of claim 13 wherein said second element comprises an electrostatic lens.

27. A time-of-flight mass spectrometer comprising:

a sample holder for a sample;

an ionizer for ionizing the sample to form ions;

an extraction plate electrically coupled to said sample holder;

a first element spaced downstream from said extraction plate;

a second element spaced downstream from said first element, with said extraction plate and said first element defining an extraction section therebetween, and with said first element and said second element defining an acceleration section therebetween;

a drift region downstream of said second element;

a power source electrically coupled to said first element for applying a constant first voltage thereto;

means electrically coupled to said extraction plate for applying said first voltage thereto for a time subsequent to ionizing the sample, and for applying a second voltage, which is different than said first voltage, after said time in order to extract the ions;

means electrically coupled to said second element for applying a time-dependent and mass-correlated voltage thereto; and means for detecting the ions.

28. The mass spectrometer of claim 27 wherein said acceleration section includes at least one separating plate for dividing said acceleration section into a plurality of subsections, and further includes a plurality of series-connected resistors, with a first one of said resistors electrically connected between said first element and a first one of said at least one separating plate, and with a last one of said resistors electrically connected between said second element and a last one of said at least one separating plate, in order to divide said time-dependent and mass-correlated voltage between said sub-sections.

29. The mass spectrometer of claim 27 wherein said spectrometer is a reflectron.

30. A method of mass-correlating the extraction of ions for a time-of-flight mass spectrometer comprising:

ionizing a sample to form ions;

employing an extraction plate adjacent the sample;

employing a first element spaced downstream from said extraction plate;

employing a second element spaced downstream from said first element;

employing a drift region downstream of said second element;

establishing an electric field between said extraction plate and said first element at a time subsequent to ionizing the sample;

extracting the ions;

establishing a time-dependent and mass-correlated electric field between at least one of: (a) said first element and said second element, and (b) said extraction plate and said first element; and detecting the ions.

31. The method of claim 30 further comprising:

employing as said ions a first ion having a mass and a first velocity and a second ion having said mass and a second velocity, with said first velocity being different than said second velocity; and employing said time-dependent and mass-correlated electric field to compensate for the difference between said first and second velocities.

32. The method of claim 31 further comprising:

establishing said time-dependent and mass-correlated electric field between said first element and said second element.

33. The method of claim 31 further comprising:

establishing said time-dependent and mass-correlated electric field between said extraction plate and said first element.

34. The method of claim 32 further comprising:

employing as said mass a first mass;

employing as said ions a third ion having a second mass, with said second mass being greater than said first mass;

providing no compensation for said third ion when said second mass is greater than or equal to a predetermined mass.

35. The method of claim 33 further comprising:

employing as said mass a first mass;

employing as said ions a third ion having a second mass, with said second mass being less than said first mass; and providing no compensation for said third ion when said second mass is less than or equal to a predetermined mass.

36. The method of claim 30 further comprising:

employing as said ions a first ion having a first mass and a first velocity, a second ion having said first mass and a second velocity, with said first velocity being different than said second velocity, a third ion having a second mass and a third velocity, and a fourth ion having said second mass and a fourth velocity, with said third velocity being different than said fourth velocity, with said first mass being less than said second mass, and with said first and second velocities being greater than said third and fourth velocities;

employing said time-dependent and mass-correlated electric field to compensate for the difference between said first and second velocities, and for the difference between said third and fourth velocities.

* * * * *

UNITED STATES PATENT AND TRADEMARK OFFICE

CERTIFICATE OF CORRECTION

PATENT NO. : 6,518,568 B1 
DATED : February 11, 2003
INVENTOR(S) : Viatcheslav V. Kovtoun et al.

It is certified that error appears in the above-identified patent and that said Letters Patent is hereby corrected as shown below:

Column 4,
Line 32, "$E_{96}$" should read -- $E_{\tau}$ --.

Column 9,
Line 10, after "from" insert -- Equation 2 --.

Column 12,
Line 20, replace the entire line with -- $\tilde{t}_B = t_B/\tau,\ \tilde{t}_A = t_A/\tau$ --.

Column 13,
Line 31, after "$M_o$)" insert -- ) --.

Column 16,
Line 19, "he" should read -- the --.

Column 19,
Line 10, "$MH^+<3820$" should read -- $MH^+ \leq 3820$ --.

Signed and Sealed this

Eighth Day of July, 2003

JAMES E. ROGAN
*Director of the United States Patent and Trademark Office*